US010466614B2

(12) United States Patent
Furuta et al.

(10) Patent No.: US 10,466,614 B2
(45) Date of Patent: Nov. 5, 2019

(54) DEVELOPING DEVICE, IMAGE FORMING APPARATUS, AND DEVELOPING CONDITION CORRECTING METHOD

(71) Applicant: Konica Minolta, Inc., Tokyo (JP)

(72) Inventors: Tatsuya Furuta, Tokyo (JP); Hiroshi Morimoto, Tokyo (JP); Keiki Katsumata, Tokyo (JP); Satoru Nagata, Tokyo (JP); Daiki Watanabe, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/279,715

(22) Filed: Feb. 19, 2019

(65) Prior Publication Data

US 2019/0258189 A1 Aug. 22, 2019

(30) Foreign Application Priority Data

Feb. 22, 2018 (JP) ..... 2018-030028

(51) Int. Cl.

| | |
|---|---|
| ***G03G 15/06*** | (2006.01) |
| ***G03G 15/00*** | (2006.01) |
| ***G03G 15/08*** | (2006.01) |

(52) U.S. Cl.
CPC ..... *G03G 15/065* (2013.01); *G03G 15/0808* (2013.01); *G03G 15/5041* (2013.01); *G03G 15/5058* (2013.01); *G03G 2215/00037* (2013.01)

(58) Field of Classification Search
None
See application file for complete search history.

(56) References Cited

U.S. PATENT DOCUMENTS 4,266,868 A * 5/1981 Bresina ..... G03G 15/09 399/269
2014/0056605 A1* 2/2014 Uehara ..... G03G 15/0848 399/49

FOREIGN PATENT DOCUMENTS

JP 2012-211937 A 11/2012

* cited by examiner

*Primary Examiner* — Victor Verbitsky
(74) *Attorney, Agent, or Firm* — Lucas & Mercanti, LLP

(57) ABSTRACT

A developing device includes a hardware processor that performs control not to cause an image to be formed on an image bearing member by a first developer bearing member and to cause a first image to be formed on the image beating member by a second developer bearing member, in which the hardware processor corrects developing conditions of the plural developer bearing members based on a developability detection result of the first image formed by the second developer bearing member.

15 Claims, 15 Drawing Sheets

DEVELOPING DEVICE, IMAGE FORMING APPARATUS, AND DEVELOPING CONDITION CORRECTING METHOD

CROSS REFERENCE TO RELATED APPLICATIONS

The entire disclosure of Japanese patent Application No. 2018-030028, filed on Feb. 22, 2018, is incorporated herein by reference in its entirety.

BACKGROUND

Technological Field

The present invention relates to a developing device, an image forming apparatus, and a developing condition correcting method.

Description of the Related Art

Generally, an image forming apparatus (printer, copier, facsimile machine, and the like.) utilizing an electrophotographic process technology irradiates (exposes) a charged photoconductor drum (image bearing member) with laser light based on image data to form an electrostatic latent image. Then, toner is supplied from a developing device to the photoconductor drum on which the electrostatic latent image is formed, whereby the electrostatic latent image is visualized to form a toner image. Further, the toner image is directly or indirectly transferred to a sheet, and then heated and pressurized at a fixing nip, whereby the toner image is formed on the sheet.

In the developing device used in the image forming apparatus, a device is known including a plurality of developing rollers. In such a developing device, the toner is supplied to the image bearing member from each of the plurality of developing rollers. When density variation occurs in an image formed on the image bearing member formed by the toner, image density correction is performed based on the density variation.

For example, in Japanese Patent Application Laid-Open No. 2012-211937, a configuration is disclosed in which when density variation of an image occurs due to runout of the image bearing member, a phase of a developing bias applied to one developing roller and a phase of a developing bias applied to the other developing roller are made different from each other.

SUMMARY

However, since the above-described image density correction uniformly corrects a developing condition of each developing roller, even when developabilities of respective developing rollers individually vary due to mechanical durability or the like, correction amounts of the developing condition of the respective developing rollers become the same as each other. That is, since each developability is not optimized, there is a possibility that an image defect occurs caused by individual variations in developability of the respective plurality of developing rollers.

For example, when the developing bias applied to each developing roller is uniformly changed, image quality varies such as graininess or periodic unevenness. When a circumferential speed ratio of each developing roller to the image bearing member is uniformly changed, toner scattering increases. Due to change in the developing condition of each developing roller, tone of the image formed on the image bearing member changes, so that it becomes necessary to perform stabilization correction of the image.

Note that, in the configuration described in Japanese Patent Application Laid-Open No. 2012-211937, the variation in the developability of each developing roller is not considered, so above problems cannot be solved.

An object of the present invention is to provide a developing device, an image forming apparatus, and a developing condition correcting method enabled to suppress the image defect caused by individual variations in developability of the respective plurality of developing rollers.

To achieve at least one of the abovementioned objects, according to an aspect of the present invention, a developing device reflecting one aspect of the present invention comprises:

an image bearing member that bears an image;

a plurality of developer bearing members each of which bears a developer of one color and forms on the image bearing member the image based on the developer borne by each of the developer bearing members:

a developability detector that detects a developability based on the image formed on the image bearing member, and a hardware processor that performs control not to cause the image to be formed on the image bearing member by at least one first developer bearing member among the plurality of developer bearing members and to cause a first image to be formed on the image bearing member by a second developer bearing member other than the first developer bearing member, wherein the hardware processor corrects developing conditions of the plurality of developer bearing members, based on a developability detection result of the first image formed by the second developer bearing member.

To achieve at least one of the abovementioned objects, according to an aspect of the present invention, an image forming apparatus reflecting another aspect of the present invention comprises:

an image bearing member that bears an image;

a plurality of developer bearing members each of which bears a developer of one color and forms on the image bearing member the image based on the developer borne by each of the developer bearing members;

a developability detector that detects a developability based on the image formed on the image bearing member, and a hardware processor that performs control not to cause the image to be formed on the image bearing member by at least one first developer bearing member among the plurality of developer bearing members and to cause a first image to be formed on the image bearing member by a second developer bearing member other than the first developer bearing member, wherein the hardware processor corrects developing conditions of the plurality of developer bearing members based on a developability detection result of the first image formed by the second developer bearing member.

To achieve at least one of the abovementioned objects, according to an aspect of the present invention, a developing condition correcting method reflecting another aspect of the present invention is a developing condition correcting method of a developing device including: an image bearing member that bears an image; a plurality of developer bearing members each of which bears a developer of one color and forms on the image bearing member the image based on the developer borne by each of the developer bearing members;

and a developability detector that detects a developability based on the image formed on the image bearing member, the method comprising:

performing control not to cause the image to be formed on the image bearing member by at least one first developer bearing member among the plurality of developer bearing members and to cause a first image to be formed on the image bearing member by a second developer bearing member other than the first developer bearing member; and correcting developing conditions of the plurality of developer bearing members based on a developability detection result of the first image formed by the second developer bearing member.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
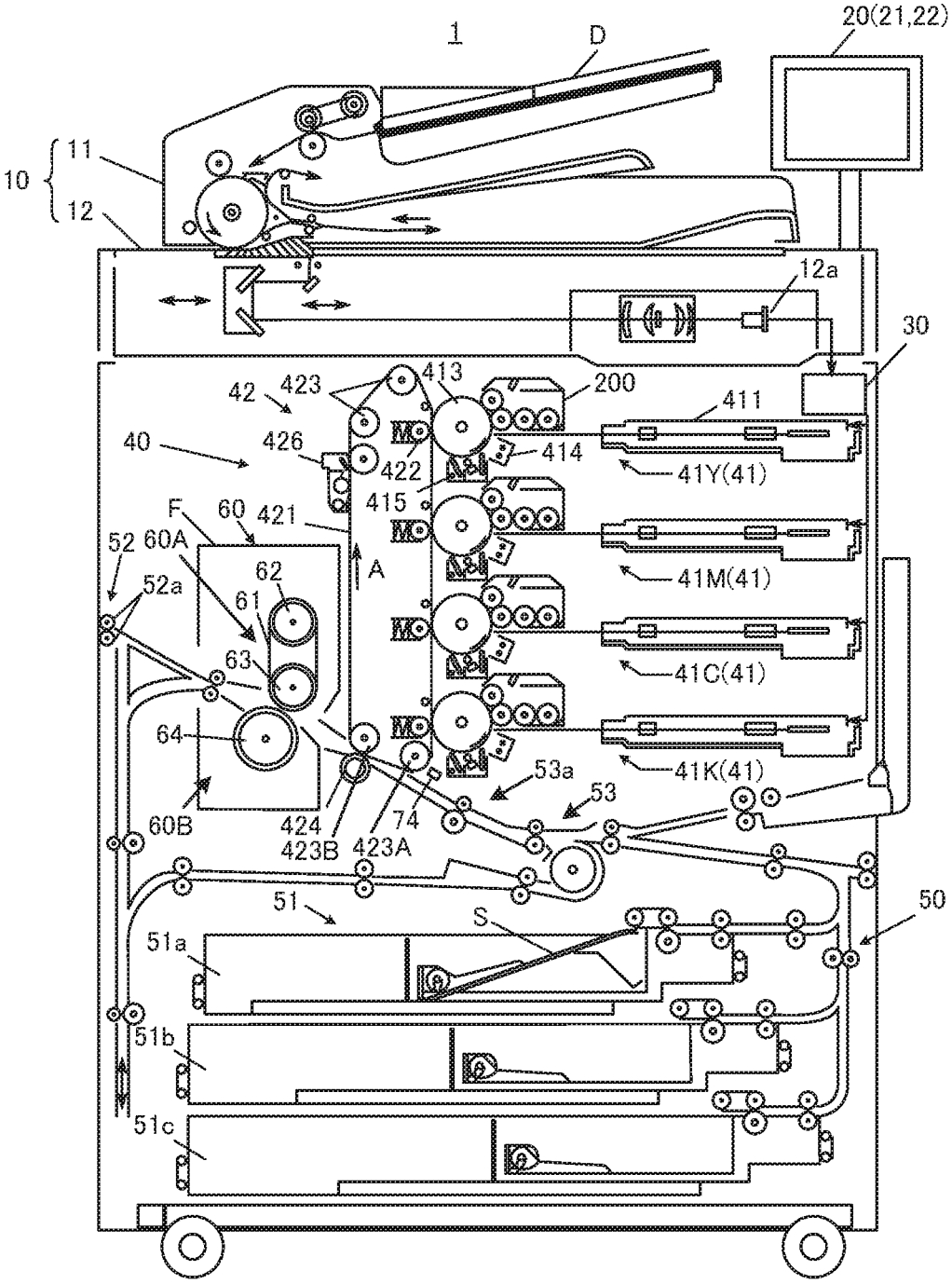
FIG. 1 is a diagram schematically illustrating an overall configuration of an image forming apparatus according to an embodiment of the present invention.
Figure 2:
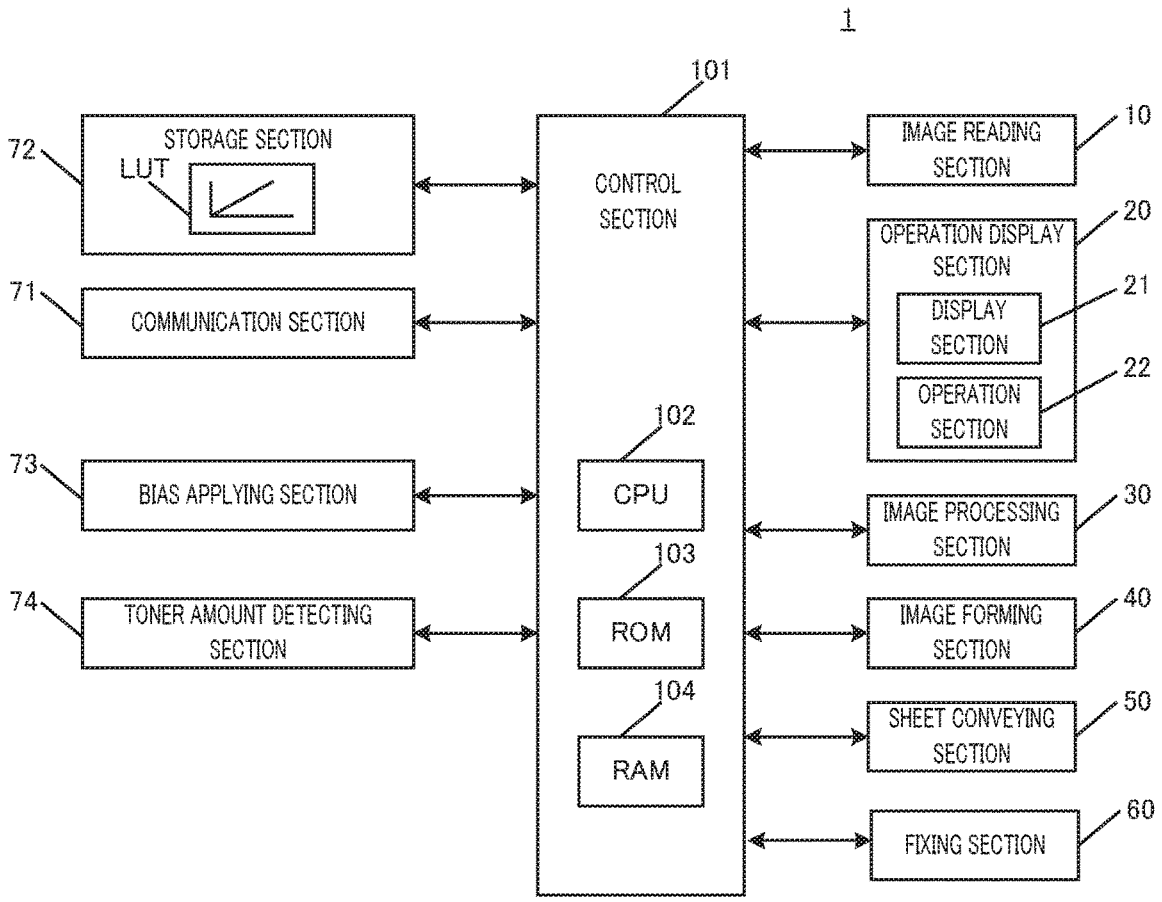
FIG. 2 is a diagram illustrating a main part of a control system of the image forming apparatus according to the present embodiment.

Hereinafter, an embodiment of the present invention will be described in detail with reference to the drawings. FIG. 1 is a diagram schematically illustrating an overall configuration of image forming apparatus 1 according to the embodiment of the present invention. FIG. 2 is a diagram illustrating a main part of a control system of image forming apparatus 1 according to the present embodiment.

As illustrated in FIG. 1, image forming apparatus 1 is an intermediate transfer type color image forming apparatus using an electrophotographic process technology. That is, image forming apparatus 1 forms an image by primarily transferring toner images of respective colors of yellow (Y), magenta (M), cyan (C), and black (K) formed on photoconductor drum 413 to intermediate transfer belt 421, and superimposing four color toner images on intermediate transfer belt 421, and then secondarily transferring the four color toner images onto sheet S fed out from sheet feed tray units 51*a* to 51*c*.

In image forming apparatus 1, a tandem system is adopted in which photoconductor drums 413 corresponding to the four colors of Y, M, C, and K are arranged in series in a traveling direction of intermediate transfer belt 421, and the toner images of respective colors are sequentially transferred to intermediate transfer belt 421 in a single procedure.

As illustrated in FIG. 2, image forming apparatus 1 includes image reading section 10, operation display section 20, image processing section 30, image forming section 40, sheet conveying section 50, fixing section 60, and control section 101.

Control section 101 includes central processing unit (CPU) 102, read only memory (ROM) 103, random access memory (RAM) 104, and the like. CPU 102 reads a program corresponding to processing details from ROM 103, deploys the program in RAM 104, and cooperates with the deployed program to centrally control operation of each block or the like of image forming apparatus 1. At this time, various data stored in storage section 72 is referred to. Storage section 72 includes, for example, a nonvolatile semiconductor memory (so-called flash memory) or a hard disk drive.

Control section 101 transmits/receives various data to/from an external device (for example, a personal computer) connected to a communication network such as a local area network (LAN), a wide area network (WAN), or the like via communication section 71. Control section 101 receives, for example, image data (input image data) transmitted from an external device, and causes an image to be formed on sheet S, based on the image data. Communication section 71 includes a communication control card such as a LAN card, for example.

As illustrated in FIG. 1, image reading section 10 includes automatic document feeder 11 called an ADF, document image scanner 12 (scanner), and the like.

Automatic document feeder 11 conveys document D placed on a document tray by a conveying mechanism and feeds the document to document image scanner 12. Automatic document feeder 11 is enabled to continuously read images (including both sides) of a large number of documents D placed on the document tray at once.

Document image scanner 12 optically scans a document conveyed onto contact glass from automatic document feeder 11 or a document placed on the contact glass, and forms an image with reflected light from the document on a light receiving surface of charge coupled device (CCD) sensor 12*a*, to read the document image. Image reading section 10 generates input image data based on a reading result by document image scanner 12. The input image data is subjected to predetermined image processing in image processing section 30.

As illustrated in FIG. 2, operation display section 20 includes, for example, a liquid crystal display (LCD) with a touch panel, and functions as display section 21 and operation section 22. Display section 21 displays various operation screens, image states, operation situations of respective functions, and the like in accordance with a display control signal input from control section 101. Operation section 22 includes various operation keys such as numeric key pads and a start key, accepts various input operations by a user, and outputs an operation signal to control section 101.

Image processing section 30 includes a circuit and the like for performing, on the input image data, digital image processing corresponding to an initial setting or a user setting. For example, image processing section 30 performs tone correction based on tone correction data (tone correction table) under control of control section 101. In addition to the tone correction, image processing section 30 applies, to the input image data, various types of correction processing such as color correction and shading correction, compression processing, and the like. Image forming section 40 is controlled based on the image data subjected to these types of processing.

As illustrated in FIG. 1, image forming section 40 includes image forming units 41Y, 41M, 41C, and 41K for forming images with color toners of Y component, M component, C component, and K component, based on input image data, intermediate transfer unit 42, and the like.

The image forming units 41Y, 41M, 41C, and 41K for Y component. M component, C component, and K component have similar configurations to each other. For convenience of illustration and explanation, common constituent elements are denoted by the same reference numerals, and when the elements are distinguished, Y, M, C, or K is added to the reference numerals. In FIG. 1, only the constituent elements of image forming unit 41Y for the Y component are denoted by reference numerals, and the reference numerals of the constituent elements of other image forming units 41M, 41C, and 41K are omitted.

Image forming unit 41 includes exposing device 411, developing device 200, photoconductor drum 413 as an example of an image bearing member, charging device 414, drum cleaning device 415, and the like.

Photoconductor drum 413 is, for example, an organic photoconductor having a photosensitive layer made of a resin containing an organic photoconductive body formed on the outer peripheral surface of a drum-shaped metallic base.

Control section 101 controls a drive current supplied to a drive motor (not illustrated) that rotates photoconductor drum 413 to rotate photoconductor drum 413 at a constant circumferential speed.

Charging device 414 is, for example, an electrification charger, and generates corona discharging to uniformly charge the surface of photoconductor drum 413 having photoconductivity to negative polarity.

Exposing device 411 includes, for example, a semiconductor laser, and irradiates photoconductor drum 413 with laser light corresponding to an image of each color component. As a result, in an image area irradiated with the laser light in the surface of photoconductor drum 413, an electrostatic latent image of each color component is formed due to a potential difference with its background area.

Developing device 200 is a two-component reversal type developing device, and visualizes the electrostatic latent image by causing a developer of each color component to adhere to the surface of photoconductor drum 413, to form a toner image.

For example, developing device 200 is applied with a DC developing bias having the same polarity as a charging polarity of charging device 414, or a developing bias obtained by superimposing a DC voltage having the same polarity as the charging polarity of charging device 414 on an AC voltage. As a result, reversal developing is performed for causing the toner to adhere to the electrostatic latent image formed by exposing device 411.

Figure 3:
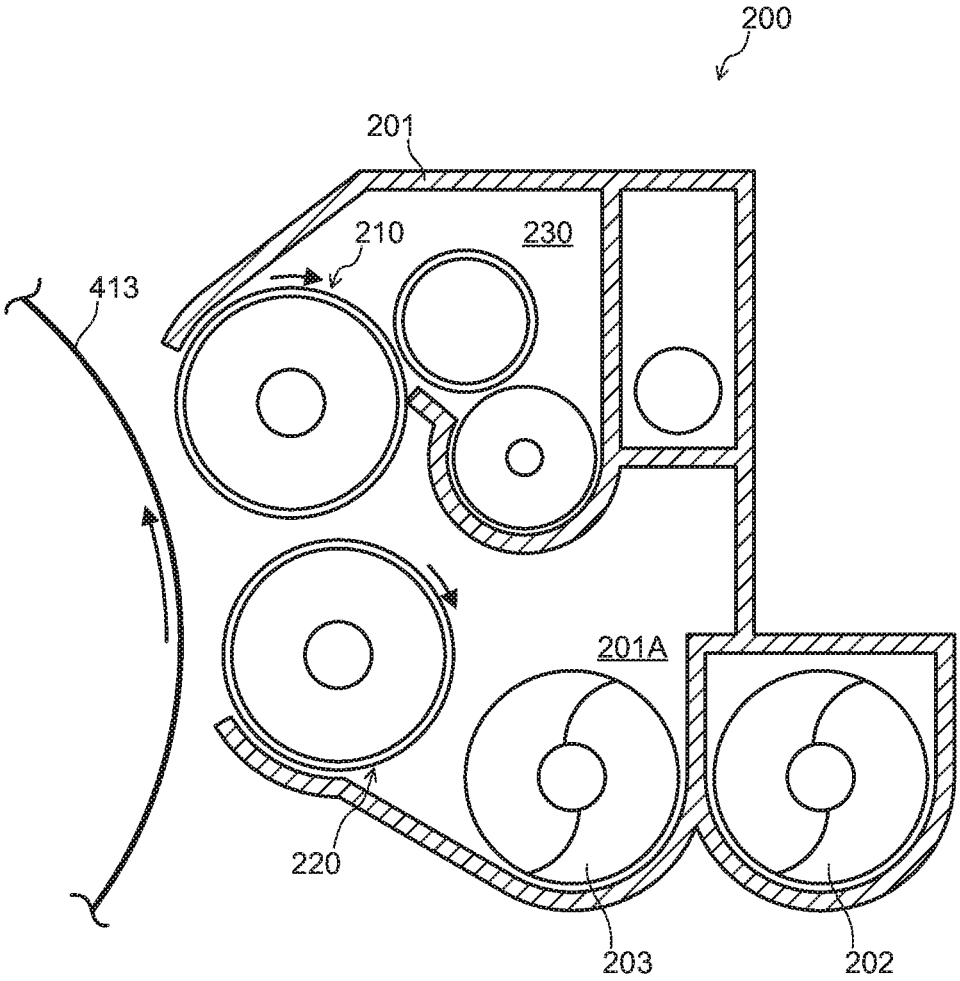
FIG. 3 is a side sectional view of a developing device.

As illustrated in FIG. 3, developing device 200 includes developer casing 201. Developer casing 201 is provided with accommodating section 201A for accommodating the developer including the toner and carrier, and collecting section 230. First agitating member 202, second agitating member 203, first developing roller 210, and second developing roller 220 are provided inside developer casing 201. First developing roller 210 corresponds to "first developer bearing member" of the present invention. Second developing roller 220 corresponds to "second developer bearing member" of the present invention.

First agitating member 202 and second agitating member 203 are configured to convey the developer in an axial direction by rotating, and agitate the developer by circulating the developer between an area of first agitating member 202 and an area of second agitating member 203, in accommodating section 201A.

First developing roller 210 and second developing roller 220 are arranged side by side in a rotation direction of photoconductor drum 413. First developing roller 210 faces photoconductor drum 413 above second developing roller 220, that is, at the downstream side of second developing roller 220 in the rotation direction of photoconductor drum 413.

First developing roller 210 is supplied with the developer from second developing roller 220, and conveys the developer toward a first developing nip that is a facing part to photoconductor drum 413. Then, first developing roller 210 supplies the toner to photoconductor drum 413 at the first developing nip.

Second developing roller 220 faces photoconductor drum 413 at the upstream side of the first developing nip in the rotation direction of photoconductor drum 413. Second developing roller 220 conveys the developer in accommodating section 201A toward a second developing nip that is a part facing photoconductor drum 413. Second developing roller 220 supplies the toner to photoconductor drum 413 at the second developing nip. Thus, an image based on the developer borne by each of first developing roller 210 and second developing roller 220 is formed on photoconductor drum 413.

Collecting section 230 is provided above accommodating section 201A, collects the developer on first developing roller 210, and returns the developer to accommodating section 201A.

Developing conditions for forming the image on photoconductor drum 413 are set in each of first developing roller 210 and second developing roller 220. The developing conditions are, for example, developing biases applied to first developing roller 210 and second developing roller 220, and circumferential speed ratios of first developing roller 210 and second developing roller 220 to photoconductor drum 413.

The developing biases are applied to first developing roller 210 and second developing roller 220 by bias applying section 73 (see FIG. 2), and a DC component of 400 V, an AC component of 1 kV, and a frequency of 5 kHz are set for both first developing roller 210 and second developing roller 220. The circumferential speed ratios of first developing roller 210 and second developing roller 220 to photoconductor drum 413 are set to 1 for both first developing roller 210 and second developing roller 220.

Under the control of control section 101, these developing conditions are corrected by developing condition correction control to be described later. Control section 101 corresponds to "image forming control section" and "correction control section" of the present invention.

As illustrated in FIG. 1, drum cleaning device 415 is in contact with the surface of photoconductor drum 413 and includes a flat plate-like drum cleaning blade made of an elastic body, and the like, and removes the toner not transferred to intermediate transfer belt 421 and remaining on the surface of photoconductor drum 413.

Intermediate transfer unit 42 includes intermediate transfer belt 421, primary transfer roller 422, a plurality of support rollers 423, secondary transfer roller 424, belt cleaning device 426, toner amount detecting section 74, and the like.

Intermediate transfer belt 421 is formed of an endless belt, and is stretched around the plurality of support rollers 423 in a loop. At least one of the plurality of support rollers 423 is formed of a drive roller, and the rest is formed of a driven roller. For example, the drive roller is preferably roller 423A arranged on the downstream side in a belt traveling direction of primary transfer roller 422 for the K component. Thus, a traveling speed of the belt at a primary transfer section is easily kept constant. Drive roller 423A rotates, whereby intermediate transfer belt 421 travels at a constant speed in a direction of arrow A.

Intermediate transfer belt 421 is a belt having conductivity and elasticity, and includes a high resistance layer on its surface. Intermediate transfer belt 421 is rotationally driven by a control signal from control section 101.

Primary transfer roller 422 is arranged on the inner peripheral surface side of intermediate transfer belt 421 to face photoconductor drum 413 of each color component. Primary transfer roller 422 is pressed against photoconductor drum 413 with intermediate transfer belt 421 in between, whereby a primary transfer nip is formed for transferring a toner image from photoconductor drum 413 to intermediate transfer belt 421.

Secondary transfer roller 424 is arranged on the outer peripheral surface side of intermediate transfer belt 421 to face backup roller 423B arranged on the downstream side in the belt traveling direction of drive roller 423A. Secondary transfer roller 424 is pressed against backup roller 423B with intermediate transfer belt 421 in between, whereby a secondary transfer nip is formed for transferring the toner images from intermediate transfer belt 421 to sheet S.

When intermediate transfer belt 421 passes through the primary transfer nip, the toner image on photoconductor drum 413 is primarily transferred to be superimposed sequentially onto intermediate transfer belt 421. Specifically, a primary transfer bias is applied to primary transfer roller 422, and a charge having an opposite polarity to the toner is given to the back side of intermediate transfer belt 421, that is, a side in contact with primary transfer roller 422, whereby the toner image is electrostatically transferred to intermediate transfer belt 421.

Thereafter, when sheet S passes through the secondary transfer nip, the toner images on intermediate transfer belt 421 are secondarily transferred to sheet S. Specifically, a secondary transfer bias is applied to secondary transfer roller 424, and a charge having an opposite polarity to the toner is given to the back side of sheet S, that is, a side in contact with secondary transfer roller 424, whereby the toner images are electrostatically transferred to sheet S. Sheet S to which the toner images have been transferred is conveyed toward fixing section 60.

Belt cleaning device 426 removes transfer residual toner remaining on the surface of intermediate transfer belt 421 after the secondary transfer.

Toner amount detecting section 74 is a sensor that detects a toner adhesion amount in the toner images (images) formed on intermediate transfer belt 421. Toner amount detecting section 74 outputs the detected toner adhesion amount to control section 101. Toner amount detecting section 74 corresponds to "developability detector" of the present invention.

Fixing section 60 includes: upper fixing section 60A including a fixing surface side member arranged on a fixing surface of sheet S, that is, a side of a surface on which the toner images are formed; a lower fixing section 60B including a back side support member arranged on the back of sheet S, that is, a side opposite to the fixing surface; a heating source; and the like. The back side support member is pressed against the fixing surface side member, whereby a fixing nip is formed for sandwiching and conveying sheet S.

Fixing section 60 heats and pressurizes, at the fixing nip, sheet S conveyed on which the toner images are secondarily transferred, to fix the toner images on sheet S. Fixing section 60 is arranged as a unit in fixing device F.

Upper fixing section 60A includes endless fixing belt 61, heating roller 62, and fixing roller 63 that are fixing surface side members. Fixing belt 61 is stretched by heating roller 62 and fixing roller 63.

Lower fixing section 60B includes pressure roller 64 as a back side support member. Pressure roller 64 forms, with fixing belt 61, the fixing nip for sandwiching and conveying sheet S.

Sheet conveying section 50 includes sheet feeding section 51, sheet ejecting section 52, conveying path section 53, and the like. In three sheet feed tray units 51*a* to 51*c* constituting sheet feeding section 51, sheets S (standard sheet, special sheet) identified based on basis weight, size, and the like are accommodated for each preset type. Conveying path section 53 includes a plurality of conveying roller pairs including registration roller pair 53*a*. A registration roller section in which registration roller pair 53*a* is arranged corrects inclination and deviation of sheet S.

Sheets S accommodated in sheet feed tray units 51*a* to 51*c* are fed out one by one from the top, and are conveyed to image forming section 40 by conveying path section 53. In image forming section 40, the toner images of intermediate transfer belt 421 are secondarily transferred onto one side of sheet S collectively, and a fixing process is performed in fixing section 60. Sheet S subjected to formation of an image is ejected to the outside of the apparatus by sheet ejecting section 52 including sheet ejection roller 52*a*.

Next, the developing condition correction control in developing device 200 will be described.

In the present embodiment, when density variation of an image occurs in which the toner adhesion amount detected by toner amount detecting section 74 does not coincide with a target value in formation of an image, density correction (hereinafter referred to as "image density correction") is performed of an image formed on photoconductor drum 413. The image density correction is performed by correcting the developing conditions in developing device 200.

Control section 101 corrects the developing conditions of at least one of first developing roller 210 and second developing roller 220 in consideration of a change in developability of each of first developing roller 210 and second developing roller 220.

Note that, the term "developability" as used herein means the toner adhesion amount adhering to photoconductor drum 413 with respect to the developing bias, or the toner adhesion amount moving to intermediate transfer belt 421 via photoconductor drum 413 and adhering to intermediate transfer belt 421.

When developing device 200 includes two developing rollers as in the present embodiment, if the developing conditions of the respective developing rollers are uniformly corrected, correction amounts of the developing conditions are the same as each other even when developabilities of respective developing rollers individually vary due to mechanical durability or the like. That is, since the developabilities of the respective developing rollers are not optimized individually, an image defect may occur caused by individual variations in developability of the respective developing rollers.

For example, when the developing bias applied to each developing roller is uniformly changed, image quality varies such as graininess or periodic unevenness. When a circumferential speed ratio of each developing roller to the image bearing member is uniformly changed, toner scattering increases. Due to change in the developing condition of each developing roller, tone of the image formed on the image bearing member changes, so that it becomes necessary to perform stabilization correction of the image.

In contrast, in the present embodiment, since the developing conditions are corrected in consideration of the change in developability of each of first developing roller 210 and second developing roller 220, occurrence of the image defect as described above is suppressed. Specifically, control section 101 forms each of patch image G1 (first image) of only by second developing roller 220, and patch image G2 (second image) by first developing roller 210 and second developing roller 220, on photoconductor drum 413.

Control section 101 acquires a first developability of second developing roller 220, based on a detection result of toner amount detecting section 74 in patch image G1. Control section 101 acquires a second developability of the whole of first developing roller 210 and second developing roller 220, based on a detection result of toner amount detecting section 74 in patch image G2. Control section 101 calculates a third developability of first developing roller 210 from the first developability and the second developability. Then, control section 101 corrects the developing conditions of at least one of first developing roller 210 and second developing roller 220, based on the first developability and the third developability.

Figure 4:
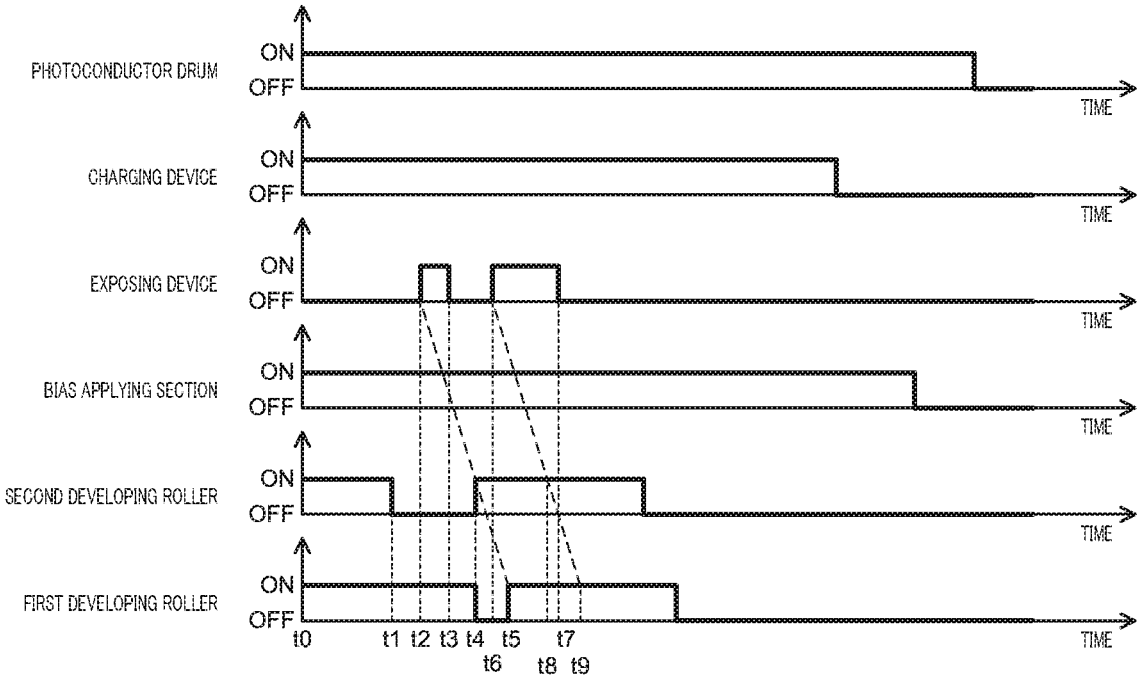
FIG. 4 is a time chart illustrating a driving situation of each part of the developing device.

Next, a flow of forming patch image G1 and patch image G2 will be described with reference to FIGS. 4 to 10. FIG. 4 is a time chart illustrating a driving situation of each part of developing device 200. FIGS. 5 to 10 are diagrams for explaining operation of developing device 200 in the developing condition correction control.

Note that, in FIG. 4, "ON" in "photoconductor drum", "second developing roller" and "first developing roller" indicates that these members are rotationally driven, and "OFF" indicates that the members are not rotationally driven and are stopped. In "charging device", "ON" indicates that charging device 414 charges the surface of photoconductor drum 413, and "OFF" indicates that charging device 414 does not charge the surface of photoconductor drum 413. In "exposing device", "ON" indicates that exposing device 411 exposes the surface of photoconductor drum 413, and "OFF" indicates that exposing device 411 does not expose the surface of photoconductor drum 413. In "bias applying section", "ON" indicates that bias applying section 73 applies the developing bias to each developing roller, and "OFF" indicates that bias applying section 73 does not apply the developing bias to each developing roller.

Figure 5:
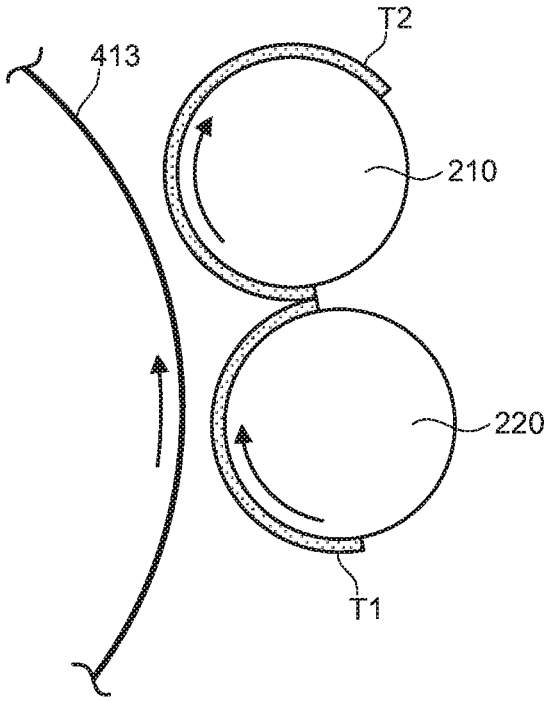
FIG. 5 is a diagram for explaining operation of the developing device in developing condition correction control.

As illustrated in FIGS. 4 and 5, at time t0, control section 101 rotationally drives photoconductor drum 413, first developing roller 210, and second developing roller 220. In the present embodiment, photoconductor drum 413 rotates in the counterclockwise direction in FIG. 5 and the like. Both first developing roller 210 and second developing roller 220 rotate in the clockwise direction in FIG. 5 and the like.

At time t0, control section 101 turns on charging device 414 and bias applying section 73, and turns off exposing device 411. Thus, developer T1 is supplied to second developing roller 220 from accommodating section 201A of developer casing 201 (lower end part of second developing roller 220 in FIG. 5 and the like).

By rotation of second developing roller 220, developer T1 is conveyed to a facing nip in which first developing roller 210 and second developing roller 220 face each other, and at the facing nip, supplied from second developing roller 220 to first developing roller 210.

Note that, in FIG. 5 and the like, illustration is omitted of remaining developer T1 not supplied to first developing roller 210 after the facing nip in second developing roller 220.

Developer T2 supplied from second developing roller 220 to first developing roller 210 is conveyed by rotation of first developing roller 210, collected at a part facing collecting section 230 (diagonally upper right part of first developing roller 210 in FIG. 5 and the like), and returned to accommodating section 201A.

At this time, since the surface of photoconductor drum 413 is not exposed, the toner does not move from first developing roller 210 and second developing roller 220 to photoconductor drum 413.

Figure 6:
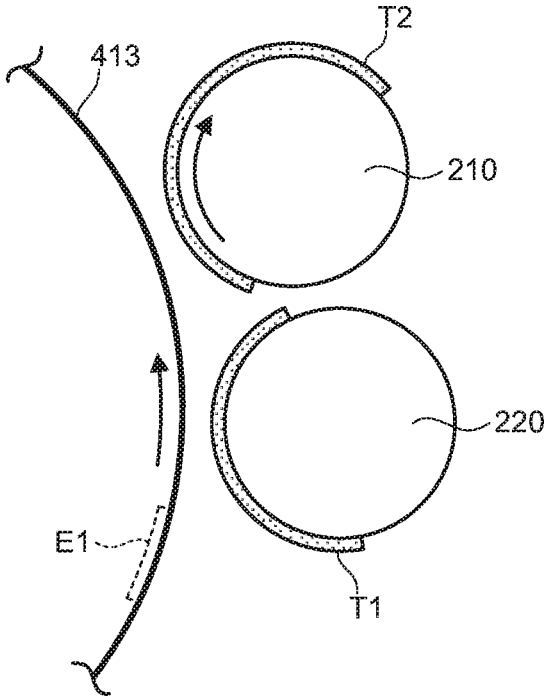
FIG. 6 is a diagram for explaining the operation of the developing device in the developing condition correction control.

As illustrated in FIGS. 4 and 6, control section 101 stops second developing roller 220 from time t1 to time t4. Thus, since second developing roller 220 does not convey developer T1, developer T1 supplied from second developing roller 220 to first developing roller 210 is exhausted at the facing nip, and eventually first developing roller 210 is not supplied with developer T1.

At this time, at a part of the second developing nip between second developing roller 220 and photoconductor drum 413, since second developing roller 220 is stopped during conveyance of developer T1, developer T1 exists.

During a period from time t2 to time t3 within a period (from time t1 to time t4) during which second developing roller 220 is stopped, control section 101 turns on exposing device 411. The surface of photoconductor drum 413 is exposed by exposing device 411 during the period from time t2 to time t3, whereby exposed portion E1 is formed on photoconductor drum 413.

Figure 7:
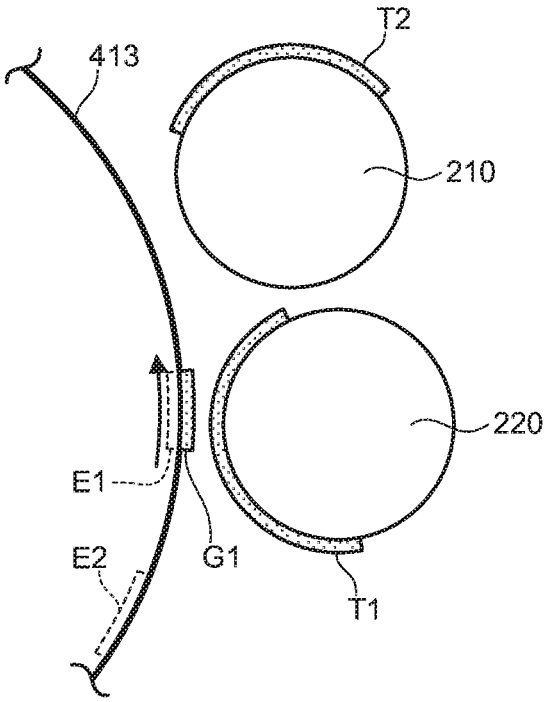
FIG. 7 is a diagram for explaining the operation of the developing device in the developing condition correction control.
Figure 8:
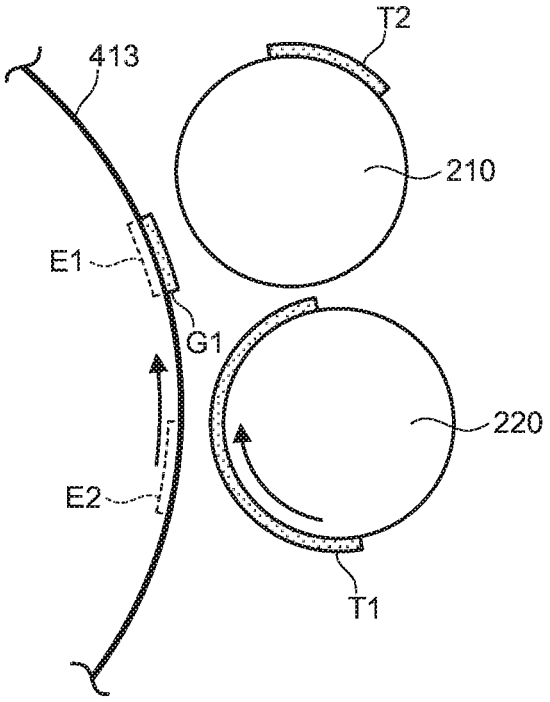
FIG. 8 is a diagram for explaining the operation of the developing device in the developing condition correction control.

As illustrated in FIGS. 4 and 7, when exposed portion E1 moves to the second developing nip with rotation of photoconductor drum 413 (time t4), since developer T1 exists in the part of the second developing nip in second developing roller 220, patch image G1 is formed in a part of exposed portion E1. As illustrated in FIGS. 4 and 8, exposed portion E1 of photoconductor drum 413 moves to a part of the first developing nip between first developing roller 210 and photoconductor drum 413, by rotation of photoconductor drum 413, at time t5.

As illustrated in FIGS. 4 and 7, after second developing roller 220 is stopped, first developing roller 210 continues to be rotationally driven. During this period, developer T2 remaining in first developing roller 210 is collected by collecting section 230.

However, during this period, developer T1 is not supplied front second developing roller 220 to first developing roller 210. For that reason, at time t4, developer T2 does not exist in the part of the first developing nip between photoconductor drum 413 and first developing roller 210.

Note that, a stop period (from time t1 to time t4) of second developing roller 220 only needs to be set so that developer T2 does not exist in the part of the first developing nip at time t4.

As illustrated in FIGS. 4, 7, and 8, control section 101 stops first developing roller 210 during a period from time t4 to time t5. Thus, after patch image G1 is formed at exposed portion E1 of photoconductor drum 413 at the second developing nip (time t4), until exposed portion E1 of photoconductor drum 413 reaches the first developing nip (time t5), a state is maintained in which formation of an image is stopped, in the first developing nip.

That is, control section 101 performs control not to cause an image to be formed on photoconductor drum 413 by first developing roller 210 and to cause patch image G1 to be formed on photoconductor drum 413 by second developing roller 220, by making stop timings of first developing roller 210 and second developing roller 220 different from each other. Thus, since patch image G1 only by second developing roller 220 is formed, the first developability of second developing roller 220 can be acquired by detecting patch image G1 moved to intermediate transfer belt 421 by toner amount detecting section 74.

Note that, a stop period (from time t4 to time t5) of first developing roller 210 only needs to be set so that exposed portion E1 of photoconductor drum 413 passes through the first developing nip while developer T2 does not exist in the first developing nip.

Control section 101 turns on exposing device 411 again during a period from time t6 that is between time t4 and time t5, to time t7 that is after time t0. Thus, the surface of photoconductor drum 413 is exposed by exposing device 411 during the time period from time t6 to time t7, whereby exposed portion E2 is formed on photoconductor drum 413.

At time t4, control section 101 resumes rotational driving of second developing roller 220. That is, when exposed portion E2 is formed on the surface of photoconductor drum 413, supply of developer T1 is resumed from developer casing 201 to second developing roller 220.

Figure 9:
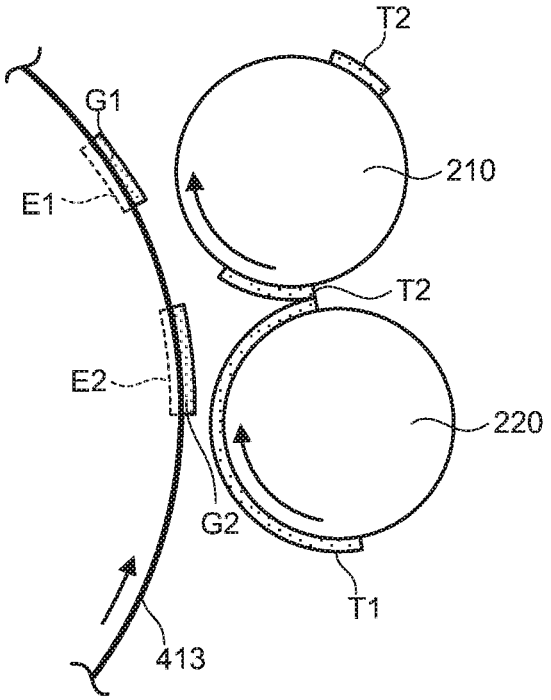
FIG. 9 is a diagram for explaining the operation of the developing device in the developing condition correction control.

Thus, as illustrated in FIGS. 4 and 9, at time t8 when exposed portion E2 of photoconductor drum 413 reaches the second developing nip, patch image G2 by second developing roller 220 is formed at a part of exposed portion E2.

Note that, a resumption timing (time t4) of the rotational driving of second developing roller 220 only needs to be a timing at which a sufficient amount of developer T1 exists in the second developing nip before exposed portion E2 reaches the second developing nip.

At time t5, control section 101 also resumes rotational driving of first developing roller 210. Thus, supply of developer T2 is also resumed from second developing roller 220 to first developing roller 210.

Note that, a resumption timing of the rotational driving of first developing roller 210 only needs to be a timing at which a sufficient amount of developer T2 exists in the first developing nip by resumption of the rotational driving of first developing roller 210 when exposed portion E2 reaches the first developing nip. However, the resumption timing of the rotational driving of first developing roller 210 needs to satisfy a condition that the developer does not exist in the first developing nip when exposed portion E1 reaches the first developing nip.

Figure 10:
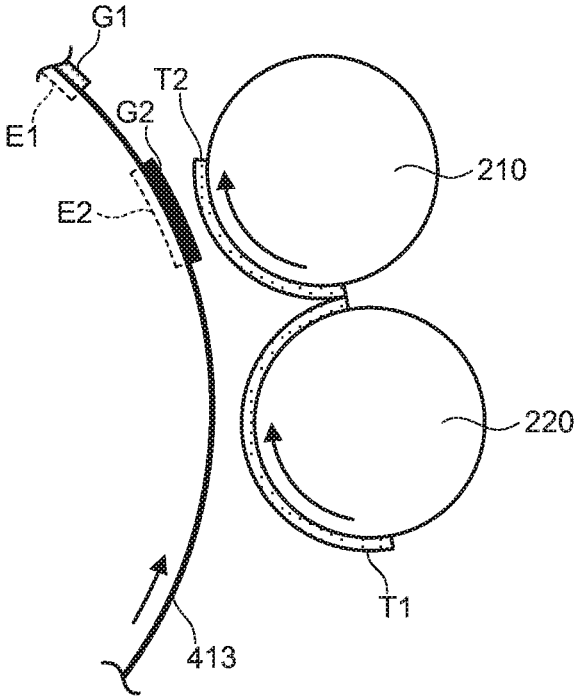
FIG. 10 is a diagram for explaining the operation of the developing device in the developing condition correction control.

As illustrated in FIG. 4 and FIG. 10, at time t9 when exposed portion E2 of photoconductor drum 413 passes through the second developing nip and then reaches the first developing nip, developer T2 is supplied from first developing roller 210 to the part of exposed portion E2. Thus, patch image G2 by all of first developing roller 210 and second developing roller 220 is formed on photoconductor drum 413.

Thus, since patch image G2 by all of first developing roller 210 and second developing roller 220 is formed, the second developability of all of first developing roller 210 and second developing roller 220 can be acquired by detecting patch image G2 by toner amount detecting section 74.

After forming patch image G1 and patch image G2 as described above, control section 101 acquires, by toner amount detecting section 74, the toner adhesion amount in each of patch images G1 and G2, that is, the first developability and the second developability. Then, control section 101 calculates the third developability of first developing roller 210, based on the first developability and the second developability. Specifically, control section 101 calculates the third developability by calculating a difference value of the first developability with respect to the second developability.

Figure 11:
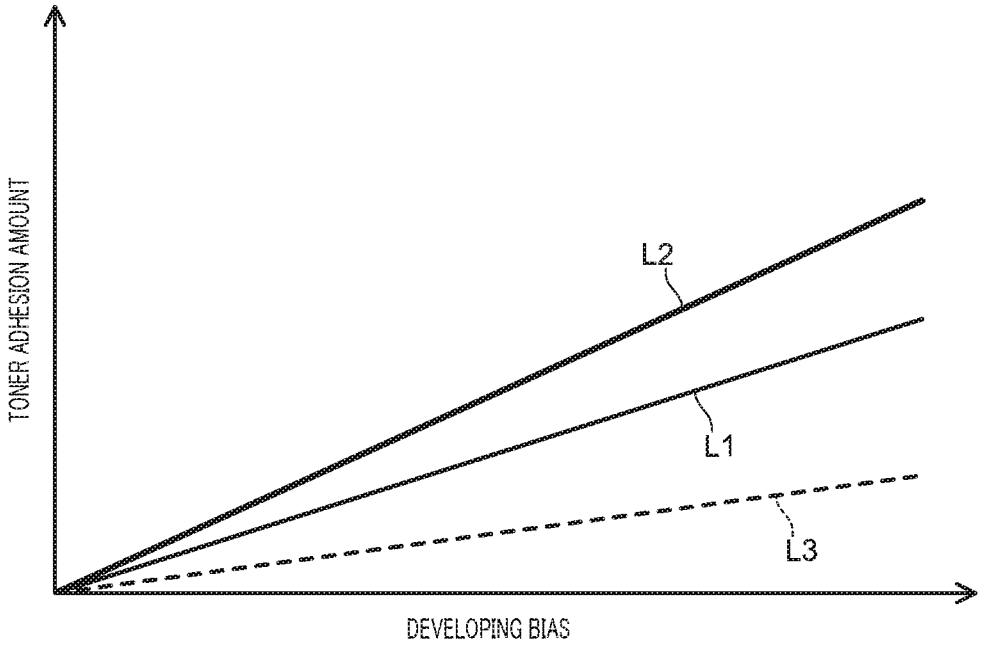
FIG. 11 is a diagram illustrating a relationship between a toner adhesion amount and a developing bias.

As illustrated in FIG. 11, regarding a relationship between the developing bias applied to the developing roller and the toner adhesion amount in photoconductor drum 413, a linear relationship is confirmed in which the toner adhesion amount increases as the developing bias increases. Solid line L1 in FIG. 11 indicates a developability by second developing roller 220, and solid line L2 indicates a developability by first developing roller 210 and second developing roller 220. In addition, broken line L3 indicates a developability by first developing roller 210. These have a relationship in which solid line L2 is obtained when solid line L1 and broken line L3 are added together.

That is, the third developability can be easily calculated by using the first developability and the second developability, so that the developability can be acquired of each of first developing roller 210 and second developing roller 220.

After calculating the first developability of second developing roller 220 and the third developability of first developing roller 210, control section 101 compares the first developability and the third developability with a standard developability, and determines correction amounts of the developing conditions of first developing roller 210 and second developing roller 220.

Figure 12:
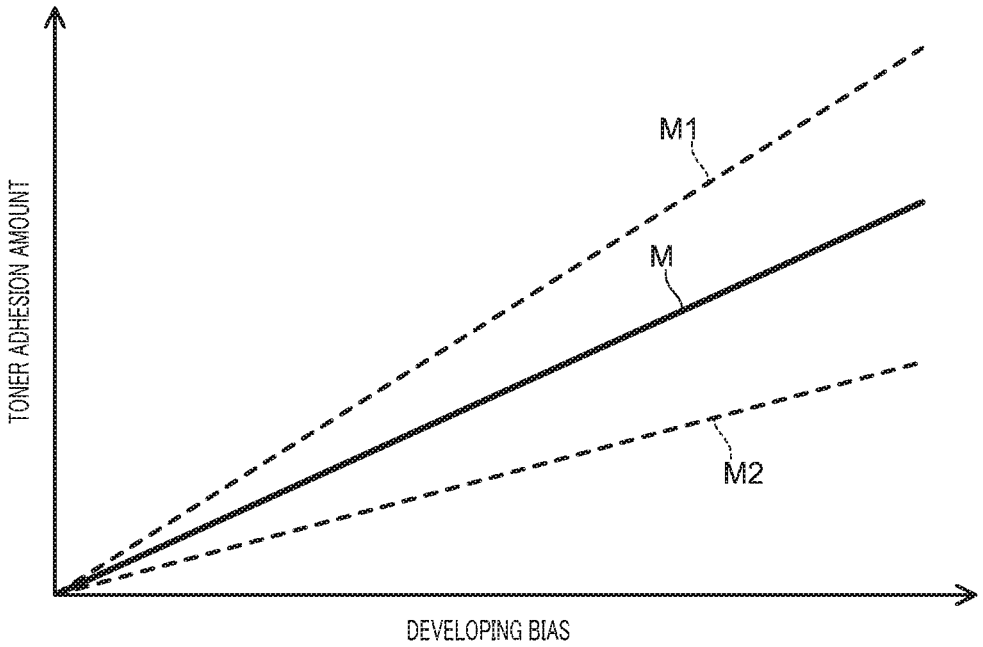
FIG. 12 is a diagram illustrating the relationship between the toner adhesion amount and the developing bias relating to a standard developability.

The standard developability is a target value of the toner adhesion amount set for each developing bias determined in advance as indicated by solid line M illustrated in FIG. 12. When the acquired developability deviates from the standard developability, control section 101 corrects the developing conditions so that the acquired developability coincides with the standard developability.

For example, when the developability is greater than the standard developability as indicated by broken line M1, control is performed to decrease the developability. When the developability is less than the standard developability as indicated by broken line M2, control is performed to increase the developability.

Tables 1 to 8 indicate correction conditions of the developing conditions for the developability of each of first developing roller 210 and second developing roller 220.

TABLE 1

| | Developability | Developing condition | |
|---|---|---|---|
| First developing roller | High | Decrease | No change |
| Second developing roller | High | Decrease | Decrease |
| Correcting method | | Both | Bias |

TABLE 2

| | Developability | Developing condition | |
|---|---|---|---|
| First developing roller | Equal | Increase | No change |
| Second developing roller | High | Decrease | Decrease |
| Correcting method | | Circumferential speed ratio | Bias |

TABLE 3

| | Developability | Developing condition | |
|---|---|---|---|
| First developing roller | Low | Increase | No change |
| Second developing roller | High | Decrease | Decrease |
| Correcting method | | Both | Bias |

TABLE 4

| | Developability | Developing condition |
|---|---|---|
| First developing roller | High | Decrease |
| Second developing roller | Equal | No change |
| Correcting method | | Both |

TABLE 5

| | Developability | Developing condition |
|---|---|---|
| First developing roller | Low | Increase |
| Second developing roller | Equal | No change |
| Correcting method | | Both |

TABLE 6

| | Developability | Developing condition | |
|---|---|---|---|
| First developing roller | High | Decrease | No change |
| Second developing roller | Low | Increase | Increase |
| Correcting method | | Both | Bias |

TABLE 7

| | Developability | Developing condition | |
|---|---|---|---|
| First developing roller | Equal | Increase | No change |
| Second developing roller | Low | Increase | Increase |
| Correcting method | | Circumferential speed ratio | Bias |

TABLE 8

| | Developability | Developing condition | |
|---|---|---|---|
| First developing roller | Low | Increase | No change |
| Second developing roller | Low | Increase | Increase |
| Correcting method | | Both | Bias |

Note that, in Tables 1 to 8, "high" of "developability" indicates that the developability of each developing roller is higher than the standard developability, "equal" indicates that the developability of each developing roller is equal to the standard developability, and "low" indicates that the developability of each developing roller is lower than the standard developability. "Increase" of "developing condition" indicates a correction condition that increases the developability, "decrease" indicates a correction condition that decreases the developability, and "no change" indicates that the developability is not changed. "Both" in "correcting method" is to correct both the circumferential speed ratio and the developing bias, "bias" is to correct only the developing bias, and "circumferential speed ratio" is to correct only the circumferential speed ratio.

Table 1 is an example in a case where both developabilities of first developing roller 210 and second developing roller 220 are higher than the standard developability. The developing condition in this case is a condition in which both the developing conditions of first developing roller 210 and second developing roller 220 are decreased (first condition in Table 1), or a condition in which only the developing condition of second developing roller 220 is decreased and the developing condition of first developing roller 210 is not changed (second condition in Table 1). In the case of the first condition in Table 1, both the circumferential speed ratio and the developing bias are corrected. In the case of the second condition in Table 1, only the developing bias is corrected.

Here, the reason why it is not necessary to change first developing roller 210 under the second condition in Table 1 is that, for example, when a variation amount of the toner adhesion amount of first developing roller 210 is relatively small with respect to the standard developability, sufficient correction can be made merely by changing only the developing condition of second developing roller 220. Although the first condition and the second condition can be arbitrarily selected, for example, when the circumferential speed ratio cannot be changed, the second condition is selected.

Table 2 is an example in a case where the developability of first developing roller 210 is equal to the standard developability, and the developability of second developing roller 220 is higher than the standard developability. The developing condition in this case is a condition in which the developing condition of first developing roller 210 is increased and the developing condition of second developing roller 220 is decreased (first condition in Table 2), or a condition in which the developing condition of second developing roller 220 is decreased and the developing condition of first developing roller 210 is not changed (second condition in Table 2). In the case of the first condition in Table 2, only the circumferential speed ratio is corrected. In the case of the second condition in Table 2, only the developing bias is corrected.

Here, the reason why the developing condition of first developing roller 210 is increased despite that the developability of first developing roller 210 has not varied under the first condition in Table 2, is to disperse the degree of correction between second developing roller 220 and first developing roller 210. The first condition and the second condition can be arbitrarily selected.

Table 3 is an example in a case where the developability of first developing roller 210 is lower than the standard developability, and the developability of second developing roller 220 is higher than the standard developability. The developing condition in this case is a condition in which the developing condition of first developing roller 210 is increased and the developing condition of second developing roller 220 is decreased (first condition in Table 3), or a condition in which the developing condition of second developing roller 220 is decreased and the developing condition of first developing roller 210 is not changed (second condition in Table 3). In the case of the first condition in Table 3, both the circumferential speed ratio and the developing bias are corrected. In the case of the second condition in Table 3, only the developing bias is corrected.

Here, the reason why it is not necessary to change first developing roller 210 under the second condition in Table 3 is that second developing roller 220 is a part to which the developer is directly supplied from developer casing 201 and can be considered as a dominant part in variation of developability in Table 3. Although the first condition and the second condition can be arbitrarily selected, for example, when the circumferential speed ratio cannot be changed, the second condition is selected.

Table 4 is an example in a case where the developability of first developing roller 210 is higher than the standard developability, and the developability of second developing roller 220 is equal to the standard developability. The developing condition in this case is a condition in which the developing condition of first developing roller 210 is decreased and the developing condition of second developing roller 220 is not changed. In the case of this condition, both the circumferential speed ratio and the developing bias are corrected.

Table 5 is an example in a case where the developability of first developing roller 210 is lower than the standard developability, and the developability of second developing roller 220 is equal to the standard developability. The developing condition in this case is a condition in which the developing condition of first developing roller 210 is increased and the developing condition of second developing roller 220 is not changed. In the case of this condition, both the circumferential speed ratio and the developing bias are corrected.

Table 6 is an example in a case where the developability of first developing roller 210 is higher than the standard developability, and the developability of second developing roller 220 is lower than the standard developability. The developing condition in this case is a condition in which the developing condition of first developing roller 210 is decreased and the developing condition of second developing roller 220 is increased (first condition in Table 6), or a condition in which the developing condition of second developing roller 220 is increased and the developing condition of first developing roller 210 is not changed (second condition in Table 6). In the case of the first condition in Table 6, both the circumferential speed ratio and the developing bias are corrected. In the case of the second condition in Table 6, only the developing bias is corrected.

Here, the reason why it is not necessary to change first developing roller 210 under the second condition in Table 6 is that second developing roller 220 is a part to which the developer is directly supplied from developer casing 201, and can be considered as a dominant part in variation of developability in Table 6. Although the first condition and the second condition can be arbitrarily selected, for example, when the circumferential speed ratio cannot be changed, the second condition is selected.

Table 7 is an example in a case where the developability of first developing roller 210 is equal to the standard developability, and the developability of second developing roller 220 is lower than the standard developability. The developing condition in this case is a condition in which the developing condition of first developing roller 210 is increased and the developing condition of second developing roller 220 is increased (first condition in Table 7), or a condition in which the developing condition of second developing roller 220 is increased and the developing condition of first developing roller 210 is not changed (second condition in Table 7). In the case of the first condition in Table 7, only the circumferential speed ratio is corrected. In the case of the second condition in Table 7, only the developing bias is corrected.

Here, the reason why the developing condition of first developing roller 210 is increased despite that the developability of first developing roller 210 has not varied under the first condition in Table 7, is to disperse the degree of correction between second developing roller 220 and first developing roller 210. The first condition and the second condition can be arbitrarily selected.

Table 8 is an example in a case where both developabilities of first developing roller 210 and second developing roller 220 are lower than the standard developability. The developing condition in this case is a condition in which both the developing conditions of first developing roller 210 and second developing roller 220 are increased (first condition in Table 8), or a condition in which only the developing condition of second developing roller 220 is increased and the developing condition of the first developing roller 210 is not changed (second condition in Table 8). In the case of the first condition in Table 8, both the circumferential speed ratio and the developing bias are corrected. In the case of the second condition in Table 8, only the developing bias is corrected.

Here, the reason why it is not necessary to change first developing roller 210 under the second condition in Table 8 is that, for example, when a variation amount is relatively small of the toner adhesion amount of first developing roller 210 with respect to the standard developability, sufficient correction can be made merely by changing only the developing condition of second developing roller 220. Although the first condition and the second condition can be arbitrarily selected, for example, when the circumferential speed ratio cannot be changed, the second condition is selected.

Note that, in the above description, each correction amount is appropriately determined depending on a change amount of each developability with respect to the standard developability. For example, in a case where correction is performed to decrease the developing bias, when a developability 1.2 times higher than the standard developability is detected, correction is performed to multiply the developing bias by 1/1.2.

Figure 13:
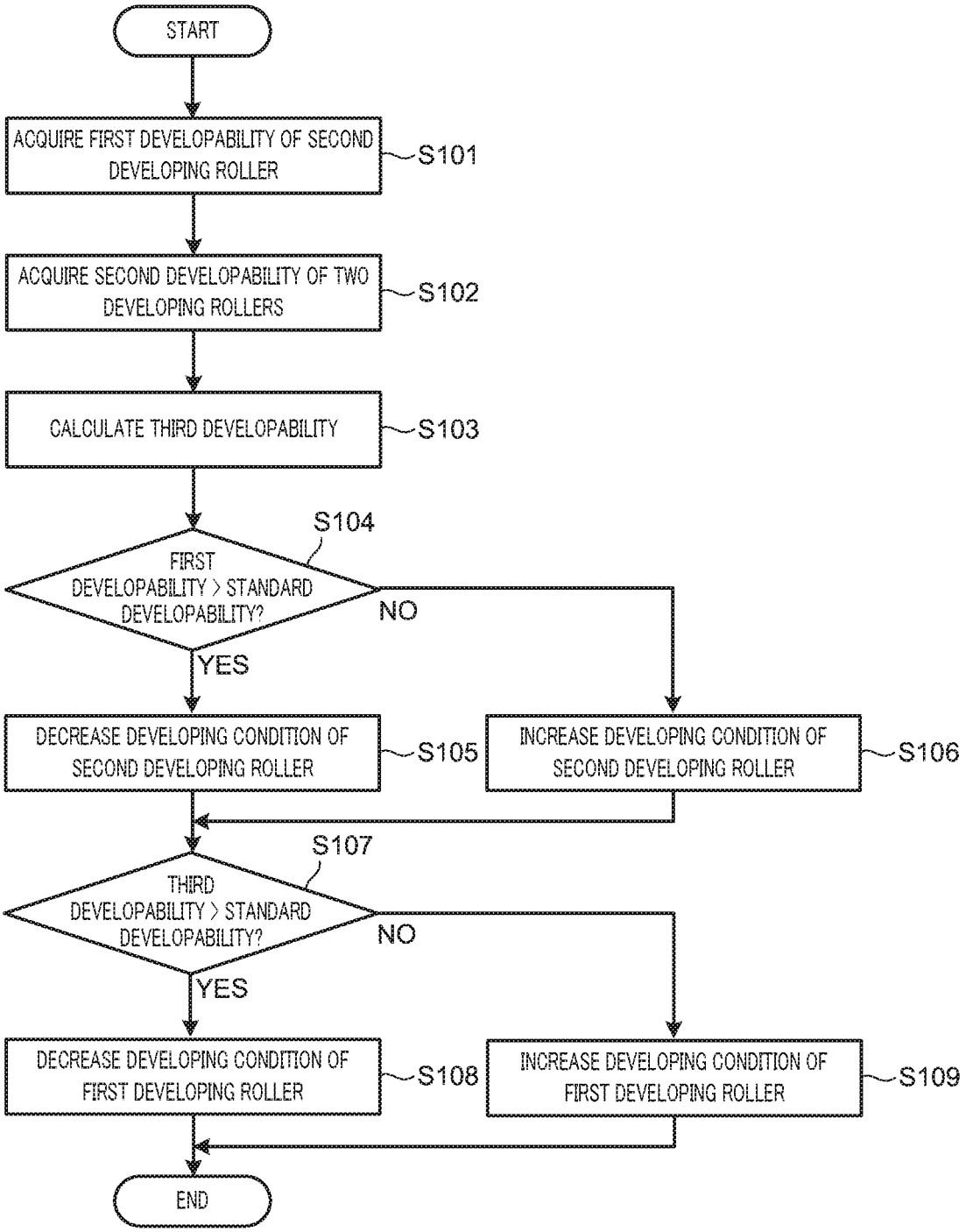
FIG. 13 is a flowchart illustrating an example of an operation example when the developing condition correction control is executed in the image forming apparatus.

Next, an operation example will be described when the developing condition correction control is executed in image forming apparatus 1. FIG. 13 is a flowchart illustrating an example of the operation example when the developing condition correction control is executed in image forming apparatus 1. Processing in FIG. 13 is executed when control section 101 accepts a signal for performing the image density correction. Note that, the processing in FIG. 13 assumes that both the first developability and the third developability have varied with respect to the standard developability.

As illustrated in FIG. 13, control section 101 acquires the first developability of second developing roller 220 (step S101). Specifically, control section 101 forms patch image G1 by second developing roller 220 on photoconductor drum 413, and acquires a detection result of toner amount detecting section 74 in patch image G1.

Next, control section 101 acquires the second developability of the two developing rollers, that is, first developing roller 210 and second developing roller 220 (step S102). Specifically, control section 101 forms patch image G2 by first developing roller 210 and second developing roller 220 on photoconductor drum 413, and acquires a detection result of the toner amount detecting section 74 in patch image G2.

Next, control section 101 calculates the third developability (step S103). Specifically, control section 101 calculates the third developability that is a difference value of the first developability with respect to the second developability.

Next, control section 101 determines whether or not the first developability is greater than the standard developability (step S104). As a result of the determination, when the first developability is greater than the standard developability (YES in step S104), control section 101 decreases the developing condition of second developing roller 220 (step S105).

On the other hand, when the first developability is not greater than the standard developability, in other words, when the first developability is less than the standard developability (NO in step S104), control section 101 increases the developing condition of second developing roller 220 (step S106).

After step S105 and step S106, control section 101 determines whether or not the third developability is greater than the standard developability (step S107). As a result of the determination, when the third developability is greater than the standard developability (YES in step S107), control section 101 decreases the developing condition of first developing roller 210 (step S108).

On the other hand, when the third developability is not greater than the standard developability, in other words, when the third developability is less than the standard developability (NO in step S107), control section 101 increases the developing condition of first developing roller 210 (step S109).

After step S108 and step S109, the control is ended.

According to the present embodiment as described above, since the developabilities of first developing roller 210 and second developing roller 220 can be acquired, when the density variation of the image occurs, a contribution degree of each developing roller can be grasped. For that reason, since the developing condition can be corrected for each developing roller, the image defect can be suppressed caused by individual variations in developability of the respective developing rollers.

Since the developing condition can be corrected for each developing roller, the change can be suppressed of the tone of the image formed on photoconductor drum 413 due to the change in the developing condition of each developing roller, and eventually occurrence can be suppressed of a situation in which the stabilization correction of the image is performed.

Figure 14:
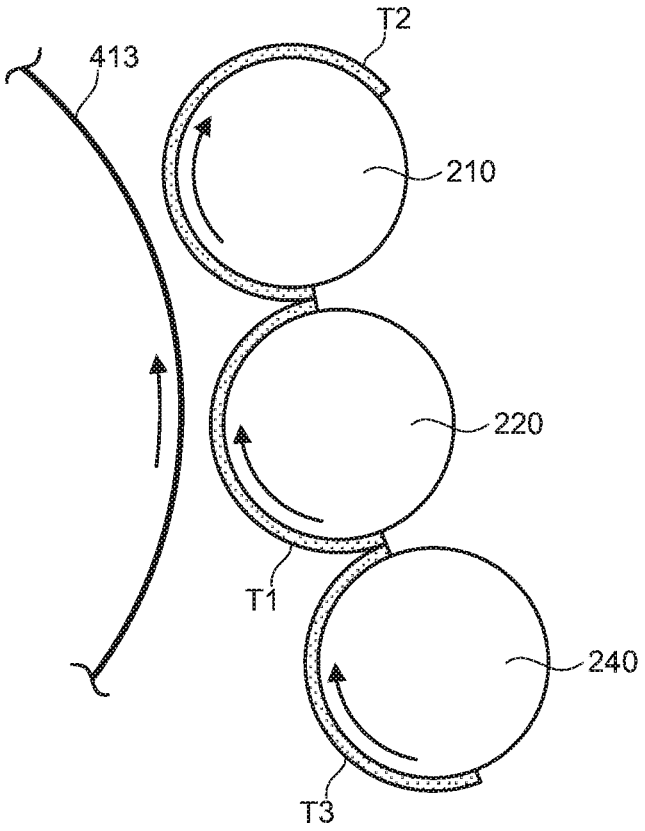
FIG. 14 is an enlarged view of a part of a first developing nip and a second developing nip of the developing device in a first modification.

Next, a first modification will be described. FIG. 14 is an enlarged view of a part of the first developing nip and the second developing nip of developing device 200 in the first modification.

As illustrated in FIG. 14, developing device 200 includes supply roller 240. In the above-described embodiment, the developer is directly supplied from developer casing 201 to second developing roller 220, but in the first modification, supply roller 240 supplies the developer in accommodating section 201A to second developing roller 220. Supply roller 240 is below second developing roller 220 and face thereto. A rotation direction of supply roller 240 is the counterclockwise direction in FIG. 14.

Supply roller 240 is supplied with developer T3 at a substantially lower end part from accommodating section 201A, conveys developer T3 to a supply nip of a facing part of second developing roller 220, and supplies the developer to second developing roller 220 at the supply nip. Operation after the developer is delivered to second developing roller 220 is similar to the operation in the above-described embodiment.

Next, the developing condition correction control will be described in developing device 200 according to the first modification.

In the above-described embodiment, the developing condition correction control is performed based on patch image G1 by second developing roller 220 and patch image G2 by first developing roller 210 and second developing roller 220.

In contrast, in the first modification, the developing condition correction control is performed by forming, on photoconductor drum 413, patch images G3 and G4 respectively by first developing roller 210 and second developing roller 220.

Control section 101 acquires a fourth developability of first developing roller 210 based on a detection result of patch image G3 (first image), and a fifth developability of second developing roller 220 based on patch image G4 (third image). Control section 101 corrects the developing conditions of first developing roller 210 and second developing roller 220, based on the fourth developability and the fifth developability. First developing roller 210 corresponds to "second developer bearing member" of the present invention, and second developing roller 220 corresponds to "first developer bearing member" of the present invention.

Figure 15:
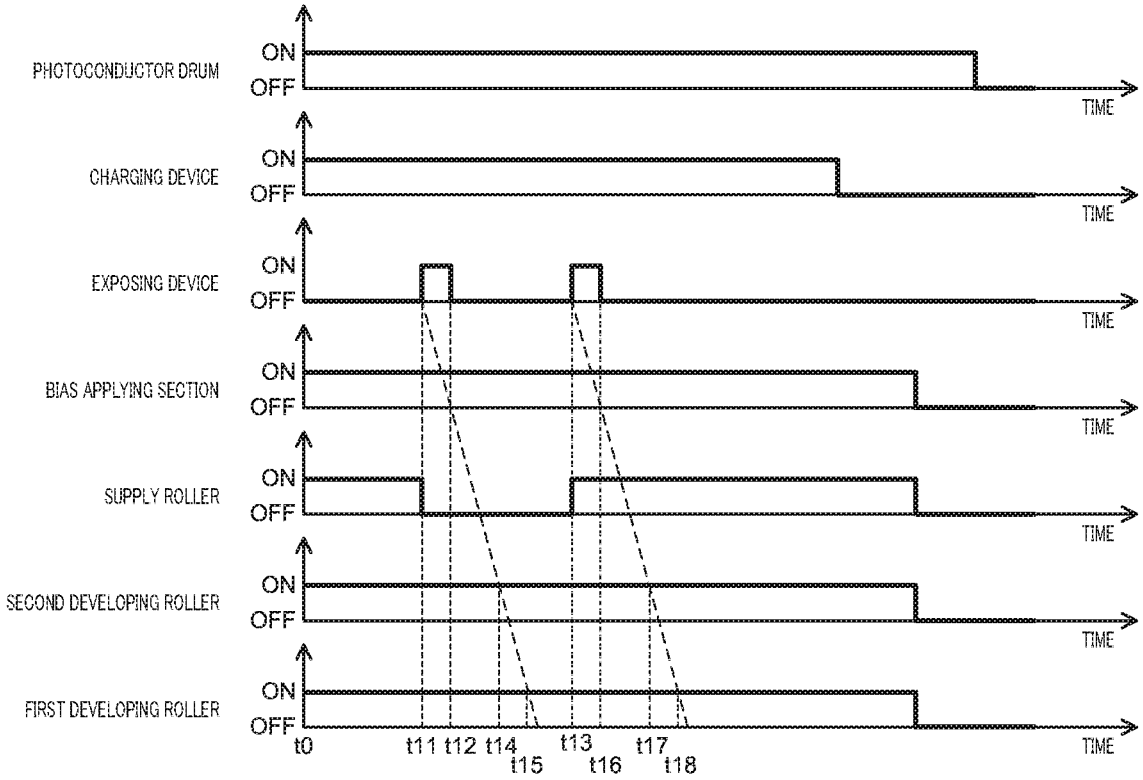
FIG. 15 is a time chart illustrating a driving situation of each part of the developing device in the first modification.

Next, a flow of forming patch image G3 and patch image G4 will be described with reference to FIGS. 14 to 19. FIG. 15 is a time chart illustrating a driving situation of each part of developing device 200 in the first modification. FIGS. 16 to 19 are diagrams for explaining operation of developing device 200 in the developing condition correction control.

Note that, in "supply roller" of FIG. 15, "ON" indicates that supply roller 240 is rotationally driven, and "OFF" indicates that supply roller 240 is not rotationally driven and is stopped. Other parts are similar to those in FIG. 4. In addition, in FIGS. 14, and 16 to 19, description will be omitted of matters similar to those in the above-described embodiment.

As illustrated in FIGS. 14 and 15, at time t0, control section 101 rotationally drives photoconductor drum 413, first developing roller 210, second developing roller 220, and supply roller 240.

At time t0, control section 101 turns on charging device 414 and bias applying section 73, and turns off exposing device 411. Thus, the developer is supplied in order of supply roller 240, second developing roller 220, and first developing roller 210. In addition, since exposing device 411 is turned OFF, the toner is not supplied to photoconductor drum 413 at the first developing nip and the second developing nip.

Note that, in FIG. 14 and the like, illustration is omitted of remaining developer T3 not supplied to second developing roller 220 after supply nip of supply roller 240.

Figure 16:
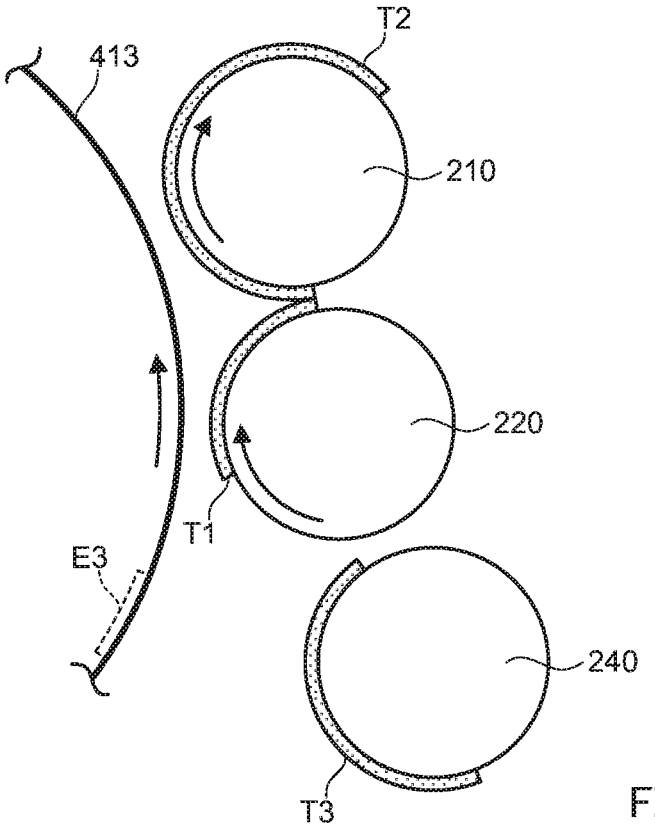
FIG. 16 is a diagram for explaining the operation of the developing device in the developing condition correction control.

As illustrated in FIGS. 15 and 16, control section 101 turns on exposing device 411 during a period from time t11 to time t12. When exposing device 411 is turned on, exposed portion E3 is formed on the surface of photoconductor drum 413.

Control section 101 stops rotational driving of supply roller 240 during a period from time t11, to time t13 that is after time t12. Thus, since developer T3 is not conveyed to the supply nip of supply roller 240, developer T1 of second developing roller 220 supplied to first developing roller 210 is exhausted, and developer T1 does not exist on second developing roller 220 (see also FIG. 17).

Figure 17:
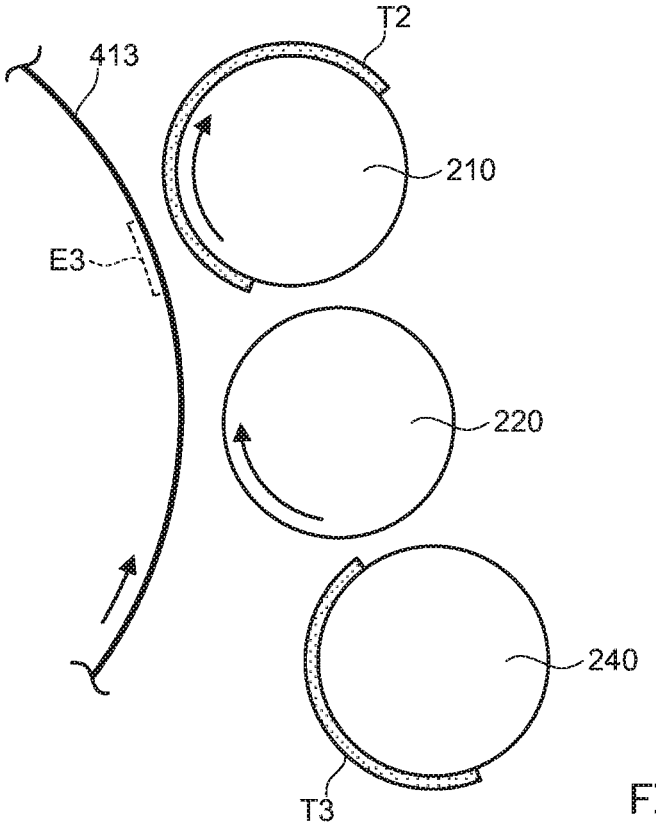
FIG. 17 is a diagram for explaining the operation of the developing device in the developing condition correction control.

Then, as illustrated in FIGS. 15 and 17, at time t14 (time before time t13) at which exposed portion E3 moves by rotation of photoconductor drum 413 and passes through the part of the second developing nip, since developer T1 does not exist in the second developing nip of second developing roller 220, exposed portion E3 passes through the second developing nip without being supplied with the toner from the second developing nip.

Note that, a stop period of supply roller 240 only needs to be set so that developer T1 does not exist in the part of second developing nip of second developing roller 220 when exposed portion E3 reaches the second developing nip. A timing at which exposing device 411 is turned on only needs to be a timing at which developer T2 exists in the part of the first developing nip of first developing roller 210 when exposed portion E3 reaches the first developing lip.

Figure 18:
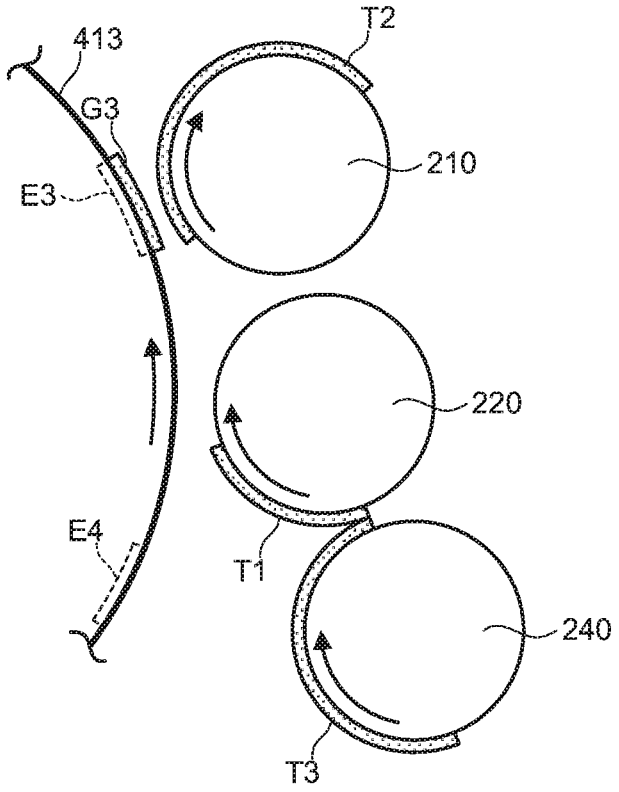
FIG. 18 is a diagram for explaining the operation of the developing device in the developing condition correction control.

At time t15 (time before time t13) at which exposed portion E3 passes through the second developing nip and then reaches the first developing nip, patch image G3 is formed in exposed portion E3 by developer T2 existing at the part of the first developing nip of first developing roller 210 (see also FIG. 18).

That is, control section 101 performs control not to cause an image to be formed on photoconductor drum 413 by second developing roller 220 and to cause patch image G3 to be formed on photoconductor drum 413 by first developing roller 210.

As illustrated in FIGS. 15 and 18, control section 101 turns on exposing device 411 during a period from time t13 to time t16. Thus, exposed portion E4 is formed on photoconductor drum 413.

At time t13, control section 101 resumes the rotational driving of supply roller 240. Thus, the developer is supplied from supply roller 240 to second developing roller 220, and at time t17 at which exposed portion E4 reaches the second developing nip, the toner is supplied to exposed portion E4, and patch image G4 is formed (see also FIG. 19).

When the rotational driving of supply roller 240 is resumed, since developer T1 does not exist in second developing roller 220, the developer is not supplied to first developing roller 210 for a while (see FIG. 17). For that reason, the developer on first developing roller 210 is completely collected by collecting section 230, and developer T2 does not exist in first developing roller 210.

Figure 19:
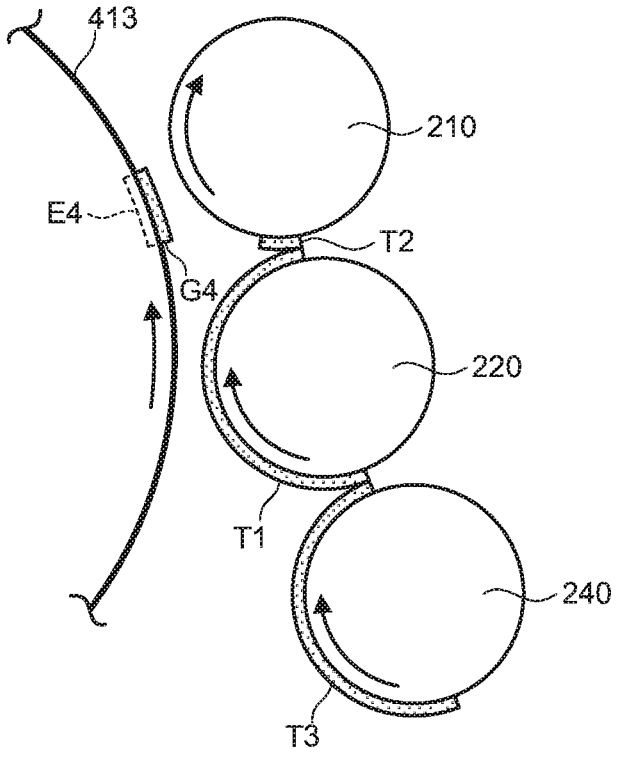
FIG. 19 is a diagram for explaining the operation of the developing device in the developing condition correction control.

As illustrated in FIGS. 15 and 19, at time t18 at which exposed portion FA reaches the first developing nip, since developer T1 does not exist in the first developing nip, the toner is not supplied from first developing roller 210 to exposed portion E4.

That is, control section 101 performs control not to cause an image to be formed on photoconductor drum 413 by first developing roller 210 and to cause patch image G4 to be formed on photoconductor drum 413 by second developing roller 220.

Note that, a resumption timing of the rotational driving of supply roller 240 only needs to be a timing at which developer T2 does not exist in the part of the first developing nip of first developing roller 210 when exposed portion E4 reaches the first developing nip. A timing at which exposing device 411 is turned on only needs to be a timing at which developer T1 exists in the part of the second developing nip of second developing roller 220 when exposed portion E4 reaches the second developing nip.

As described above, patch images G3 and G4 are formed from first developing roller 210 and second developing roller 220, respectively, so that the developabilities of first developing roller 210 and second developing roller 220 can be acquired based on these patch images, and accuracy of correction can be improved.

Control section 101 can cause first developing roller 210 and second developing roller 220 to operate all times by stopping and resuming supply of the developer from supply roller 240. Thus, the developer can be continuously conveyed all times by the two developing rollers, so that the developer can be prevented from being continuously held more than necessary on the developing roller, and eventually degradation of the developer can be suppressed.

Figure 20:
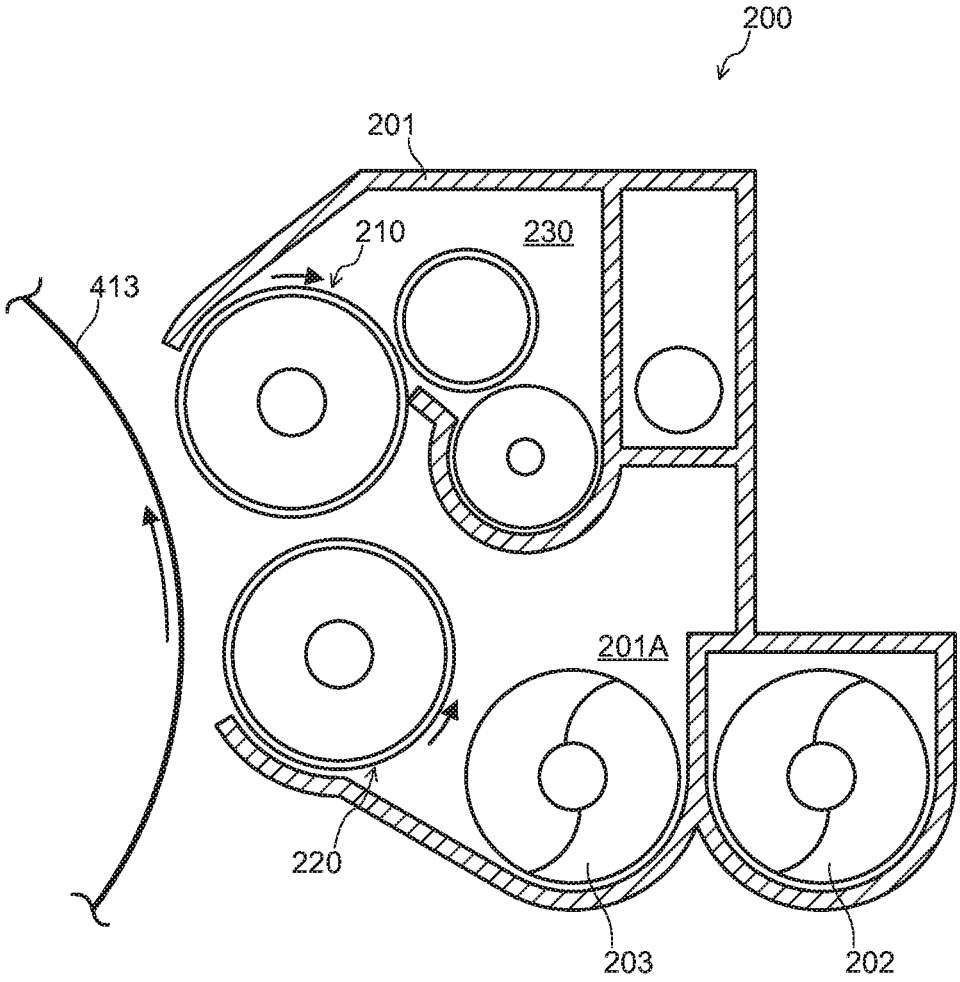
FIG. 20 is a side sectional view of a developing device according to a second modification.

Next, a second modification will be described. FIG. 20 is a side sectional view of developing device 200 according to the second modification.

As illustrated in FIG. 20, developing device 200 according to the second modification has the same configuration as the above-described embodiment illustrated in FIG. 3. In the second modification, a rotation direction of second developing roller 220 is set to the counterclockwise direction in FIG. 20. That is, the rotation direction of second developing roller 220 is set opposite to a rotation direction of first developing roller 210.

In the second modification, for example, the developer is supplied from developer casing 201 to second developing roller 220, and the developer is partially supplied to first developing roller 210 at the facing nip to first developing roller 210. Then, second developing roller 220 and first developing roller 210 supply the toner to photoconductor drum 413 at each developing nip.

The developing condition correction control in the second modification is performed in accordance with the time chart illustrated in FIG. 4, similarly to the control in the embodiment illustrated in FIG. 3. Detailed operation is substantially similar to the operation in the embodiment illustrated in FIG. 3, so that the description will be omitted.

Even in the second modification, each of the developing conditions can be corrected of first developing roller 210 and second developing roller 220, by stopping at least one of first developing roller 210 and second developing roller 220. In addition, since the control can be performed regardless of the rotation direction of second developing roller 220, usability can be improved.

Note that, in the above-described embodiment, toner amount detecting section 74 detects the patch image moved on intermediate transfer belt 421 via photoconductor drum 413; however, the present invention is not limited thereto, and toner amount detecting section 74 may directly detect the patch image on photoconductor drum 413, or may detect the patch image formed on the sheet. In addition, the developability may be detected by a laser displacement meter, current detection or torque detection in developing, or the like.

In the above-described embodiment, the developing condition correction control is performed in accordance with the time charts illustrated in FIGS. 4 and 15; however, as long as it is possible to define the timing at which each patch image is formed, the developing condition correction control may be performed in accordance with any time chart.

In the above-described embodiment, developing device 200 including two developing rollers is exemplified; however, the present invention is not limited thereto, and for example, developing device 200 including three or more developing rollers may be used.

In the above-described embodiment, second developing roller 220 supplies the developer to first developing roller 210; however, the present invention is not limited thereto, and the developer may be directly supplied to each developing roller.

Each of the above-described embodiments is merely an example illustrating an embodiment for carrying out the present invention, and the technical scope of the present invention should not be limitedly interpreted by these. That is, the present invention can be implemented in various forms without departing from the gist or the main features thereof.

Finally, an evaluation experiment will be described of image forming apparatus 1 according to the present embodiment. The developing condition correction control was performed by using developing device 200 in image forming apparatus 1 illustrated in FIG. 1 configured as illustrated in FIG. 3 (Example 1), FIG. 14 (Example 2), or FIG. 20 (Example 3). In addition, a comparative example was obtained in which the developing condition correction control was not applied and the developing rollers were uniformly subjected to correction control.

As an evaluation experiment, the toner adhesion amount of photoconductor drum 413 was measured when the developing bias was varied, and then the toner adhesion amount of photoconductor drum 413 was measured when the developing condition correction control was applied and the developing bias was varied again.

Figure 21:
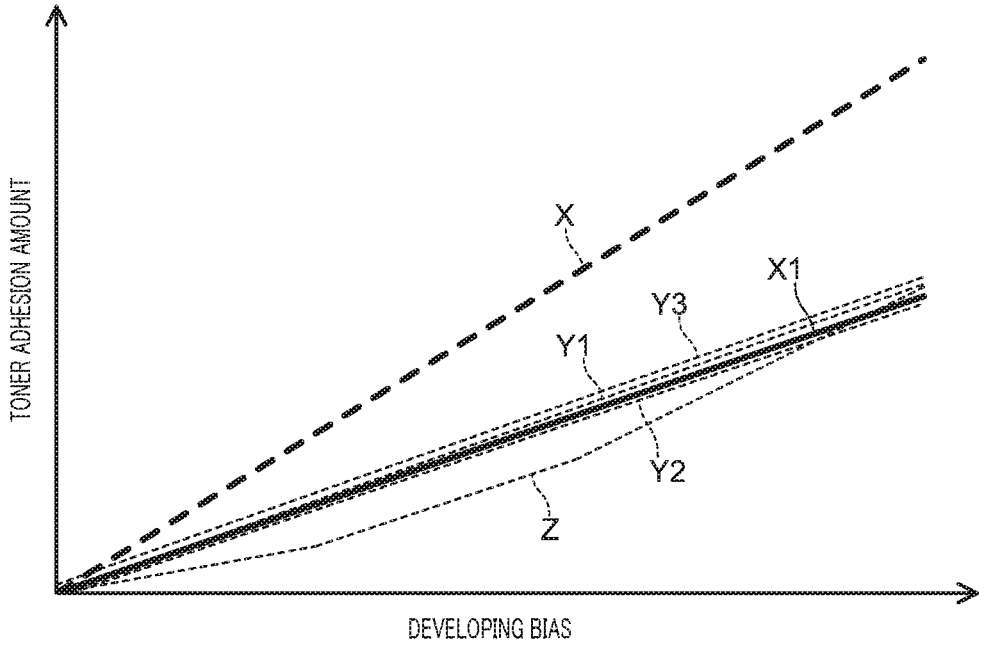
FIG. 21 is a diagram illustrating a relationship between the toner adhesion amount and the developing bias relating to an evaluation experiment result in a case where a developability becomes high.
Figure 22:
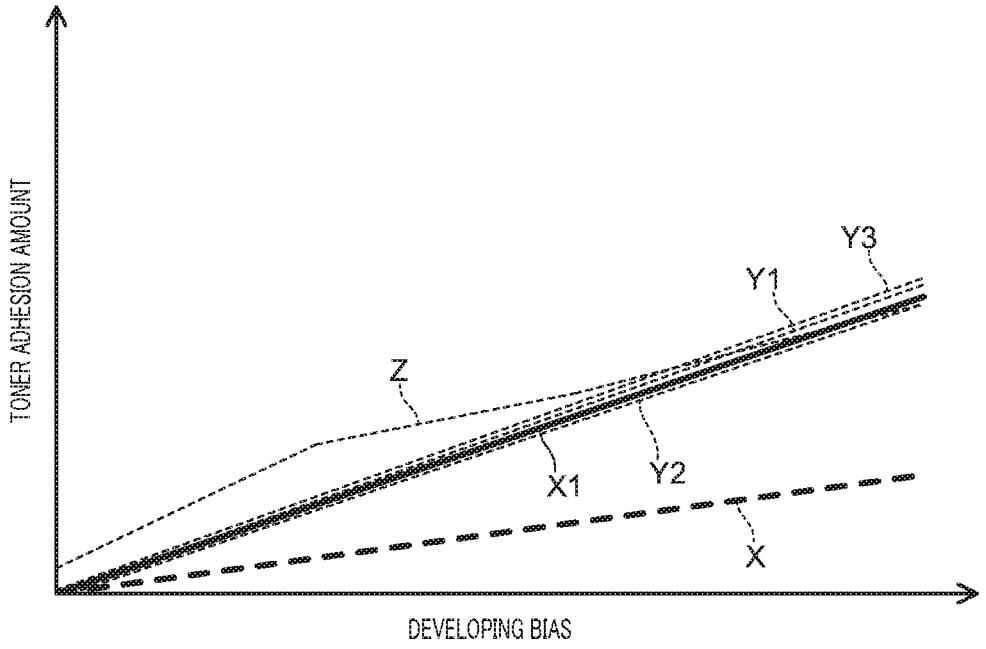
FIG. 22 is a diagram illustrating a relationship between the toner adhesion amount and the developing bias relating to the evaluation experiment result in a case where the developability becomes low.

FIG. 21 is a diagram illustrating a relationship between the toner adhesion amount and the developing bias relating to an evaluation experiment result in a case where the developability becomes high. FIG. 22 is a diagram illustrating a relationship between the toner adhesion amount and the developing bias relating to the evaluation experiment result in a case where the developability becomes low.

Broken line X in each of FIGS. 21 and 22 indicates the evaluation experiment result of Example 1, Example 2, Example 3 and the comparative example before applying the developing condition correction control. Solid line X1 indicates the standard developability. Broken line Y1 indicates the evaluation experiment result of Example 1 after applying the developing condition correction control, and broken line Y2 indicates the evaluation experiment result of Example 2 after applying the developing condition correction control. Broken line Y3 indicates the evaluation experiment result of Example 3 after applying the developing condition correction control, and broken line Z indicates the evaluation experiment result of the comparative example after performing correction control uniformly on each developing roller.

First, as illustrated in FIG. 21, in a case where the developability before applying the correction control became higher than the standard developability, in the case of the comparative example (broken line Z), after the correction control, a characteristic was obtained that was concave downward with respect to the standard developability (solid line X1). That is, in the case of the comparative example, since the toner adhesion amount after the correction deviates from the standard developability, the stabilization correction of the image becomes indispensable.

In contrast, in Example 1 (broken line Y1), Example 2 (broken line Y2), and Example 3 (broken line Y3), characteristics were obtained substantially coincided with the standard developability. That is, validity was confirmed of the developing condition correction control in the present embodiment.

Next, as illustrated in FIG. 22, in a case where the developability before applying the correction control became lower than the standard developability, in the case of the comparative example (broken line Z), after the correction control, a characteristic was obtained that protruded upward with respect to the standard developability (solid line X1). That is, in the case of the comparative example, since the toner adhesion amount after the correction deviates from the standard developability, the stabilization correction of the image becomes indispensable.

In contrast, in Example 1 (broken line Y1), Example 2 (broken line Y2), and Example 3 (broken line Y3), characteristics were obtained substantially coincided with the standard developability. That is, validity was confirmed of the developing condition correction control in the present embodiment.

Although embodiments of the present invention have been described and illustrated in detail, the disclosed embodiments are made for purposes of illustration and example only and not limitation. The scope of the present invention should be interpreted by terms of the appended claims.

What is claimed is:

1. A developing device, comprising:

an image bearing member that bears an image;

a plurality of developer bearing members each of which bears a developer of same color and forms on the image bearing member the image based on the developer borne by each of the developer bearing members;

a developability detector that detects a developability based on the image formed on the image bearing member, and a hardware processor that performs control not to cause the image to be formed on the image bearing member by at least one first developer bearing member among the plurality of developer bearing members and to cause a first image to be formed on the image bearing member by a second developer bearing member other than the first developer bearing member, wherein the hardware processor corrects developing conditions of the plurality of developer bearing members, based on a developability detection result of the first image formed by the second developer bearing member.

2. The developing device according to claim 1, wherein the hardware processor performs control to cause a second image to be formed on the image bearing member by all of the plurality of developer bearing members, and corrects the developing conditions of the plurality of developer bearing members, based on developability detection results of the first image and the second image.

3. The developing device according to claim 1, wherein the hardware processor acquires a first developability of the second developer bearing member based on the developability detection result of the first image, acquiring a second developability of the plurality of developer bearing members based on a developability detection result of the second image, calculates a third developability in the first developer bearing member based on the first developability and the second developability, and compares the first developability and the third developability with a standard developability to determine correction amounts of the developing conditions of the plurality of developer bearing members.

4. The developing device according to claim 1, wherein the plurality of developer bearing members include the first developer bearing member and the second developer bearing member that are rotatable, the second developer bearing member is supplied with the developer from a casing, the first developer bearing member is supplied with the developer from the second developer bearing member, and the hardware processor causes an image to be formed on the image bearing member by stopping and rotating at least one of the first developer bearing member and the second developer bearing member, and acquires developabilities of the plurality of developer bearing members based on the image.

5. The developing device according to claim 4, wherein the hardware processor causes an image to be formed on the image bearing member by making stop timings of the first developer bearing member and the second developer bearing member different from each other.

6. The developing device according to claim 4, wherein the hardware processor corrects the developing conditions of at least one of the first developer bearing member and the second developer bearing member based on the respective developabilities of the plurality of developer bearing members.

7. The developing device according to claim 1, wherein the hardware processor performs control not to cause an image to be formed on the image bearing member by the second developer bearing member and to cause a third image to be formed on the image bearing member by the at least one first developer bearing member, and corrects the developing conditions of the plurality of developer bearing members based on developability detection results of the third image formed by the first developer bearing member and the first image formed by the second developer bearing member.

8. The developing device according to claim 7, wherein the hardware processor acquires a fourth developability of the second developer bearing member based on the developability detection result of the first image, acquires a fifth developability of the plurality of developer bearing members based on a developability detection result of the third image, and compares the fourth developability and the fifth developability with a standard developability to determine correction amounts of the developing conditions.

9. The developing device according to claim 7, further comprising a supply member that supplies the developer to one of the plurality of developer bearing members, wherein the plurality of developer bearing members include the first developer bearing member and the second developer bearing member that are rotatable, the first developer bearing member is supplied with the developer from the supply member, the second developer bearing member is supplied with the developer from the first developer bearing member, and the hardware processor controls timing of formation of an image on the image bearing member in each of the first developer bearing member and the second developer bearing member by stopping and resuming supply of the developer from the supply member.

10. The developing device according to claim 1, wherein the hardware processor, corrects the developing conditions to increase the developability, when a developability of the developer bearing member is less than a standard developability, and corrects the developing conditions to decrease the developability, when the developability of the developer bearing member is greater than the standard developability.

11. The developing device according to claim 1, wherein the developing conditions include a condition of a circumferential speed ratio between the image bearing member and the developer bearing member.

12. The developing device according to claim 1, wherein the developing conditions include a condition of a developing bias applied to the developer bearing member.

13. The developing device according to claim 1, wherein the first developer bearing member and the second developer bearing member are arranged side by side in a rotation direction of the image bearing member that rotates, and the hardware processor corrects the developing conditions of one of the first developer bearing member and the second developer bearing member, the one being arranged on an upstream side in the rotation direction of the image bearing member.

14. An image forming apparatus, comprising:

an image bearing member that bears an image;

a plurality of developer bearing members each of which bears a developer of same color and forms on the image bearing member the image based on the developer borne by each of the developer bearing members;

a developability detector that detects a developability based on the image formed on the image bearing member; and a hardware processor that performs control not to cause the image to be formed on the image bearing member by at least one first developer bearing member among the plurality of developer bearing members and to cause a first image to be formed on the image bearing member by a second developer bearing member other than the first developer bearing member, wherein the hardware processor corrects developing conditions of the plurality of developer bearing members based on a developability detection result of the first image formed by the second developer bearing member.

15. A developing condition correcting method of a developing device including: an image bearing member that bears an image; a plurality of developer bearing members each of which bears a developer of same color and forms on the image bearing member the image based on the developer borne by each of the developer bearing members; and a developability detector that detects a developability based on the image formed on the image bearing member, the method comprising:

performing control not to cause the image to be formed on the image bearing member by at least one first developer bearing member among the plurality of developer bearing members and to cause a first image to be formed on the image bearing member by a second developer bearing member other than the first developer bearing member; and correcting developing conditions of the plurality of developer bearing members based on a developability detection result of the first image formed by the second developer bearing member.

* * * * *